US012082672B2

(12) United States Patent
Debenedictis et al.

(10) Patent No.: US 12,082,672 B2
(45) Date of Patent: Sep. 10, 2024

(54) HAIR STYLING DEVICE, HAIR STYLING METHOD AND DRIVE SYSTEM

(71) Applicant: HD3 Limited, Birmingham (GB)

(72) Inventors: Alfredo Debenedictis, Birmingham (GB); Martin Malcolm Harris, Birmingham (GB); Janusz Lucien Holland, Birmingham (GB); Mark Christopher Hughes, Birmingham (GB); James Robert Nelson, Birmingham (GB)

(73) Assignee: HD3 LIMITED, Birmingham (GB)

( * ) Notice: Subject to any disclaimer, the term of this patent is extended or adjusted under 35 U.S.C. 154(b) by 1108 days.

(21) Appl. No.: 16/755,475

(22) PCT Filed: Oct. 17, 2018

(86) PCT No.: PCT/GB2018/052981
§ 371 (c)(1),
(2) Date: Apr. 10, 2020

(87) PCT Pub. No.: WO2019/077338
PCT Pub. Date: Apr. 25, 2019

(65) Prior Publication Data

US 2021/0022468 A1 Jan. 28, 2021

(30) Foreign Application Priority Data

Oct. 17, 2017 (GB) ..... 1717021
Dec. 12, 2017 (GB) ..... 1720706

(51) Int. Cl.
*A45D 2/38* (2006.01)
*A45D 1/04* (2006.01)
(Continued)

(52) U.S. Cl.
CPC ..... *A45D 1/04* (2013.01); *A45D 2/40* (2013.01); *A45D 2001/002* (2013.01); *A45D 2001/004* (2013.01)

(58) Field of Classification Search
CPC ..... A45D 24/007; A45D 2/38; A45D 2/40; A45D 2/44; A45D 1/08
See application file for complete search history.

(56) References Cited

U.S. PATENT DOCUMENTS 1,494,507 A 5/1924 Ruffio
1,575,578 A * 3/1926 Hagemeister ..... A45D 1/08 132/129

(Continued)

FOREIGN PATENT DOCUMENTS

DE 172581 C 2/1905
EP 434713 9/1911

(Continued)

OTHER PUBLICATIONS

"Jan. 6, 2014 Notice of Allowance issued in U.S. Appl. No. 13/740,216 by Rachel Running Steitz".

(Continued)

*Primary Examiner* — Rachel R Steitz
*Assistant Examiner* — Brianne E Kalach
(74) *Attorney, Agent, or Firm* — Hultquist, PLLC; Steven J. Hultquist

(57) ABSTRACT

This invention relates to a hair styling device, a hair styling method, and a drive system suitable for use in the hair styling device. The invention relates in particular to a hair styling device (10; 210) for imparting a wave to a section of hair (36) without clamping the section of hair in the wave form. The device has a first forming member (24) and a second forming member (24) with a hair-receiving region (38) between the forming members. A driving member (20;

(Continued)

120) is movable relative to the first forming member and the second forming member to deform the section of hair in the hair-receiving region. The driving member (20; 120) undertakes a two-stage movement as it deforms the section of hair, the driving member in a first stage being movable in a first direction (D1) to drive the section of hair (36) into the hair-receiving region, the driving member (20; 120) in a second stage being movable in a second direction (D2), the second direction being at an angle to the first direction whereby in use to further move the section of hair in the hair-receiving region (38).

17 Claims, 7 Drawing Sheets

(51) Int. Cl.
*A45D 2/40* (2006.01)
*A45D 1/00* (2006.01)

(56) References Cited

U.S. PATENT DOCUMENTS 1,609,810 A 12/1926 Gates
1,636,967 A 7/1927 Perry
1,701,270 A 2/1929 Moskovitz et al.
1,709,981 A 4/1929 Headington
1,806,711 A 5/1931 Salzman
1,827,785 A 10/1931 Frederics
1,831,487 A 11/1931 Elam
1,877,776 A 9/1932 Pezzella
1,884,305 A 10/1932 Shelton
1,894,624 A 1/1933 Marcel
1,895,653 A 1/1933 Fisher
1,981,362 A 11/1934 Joyce
2,595,844 A 5/1952 Graham
2,791,225 A 5/1957 Simmons
2,867,223 A 1/1959 Anzalone
2,906,272 A 9/1959 Heidel
2,935,070 A 5/1960 Auz
3,213,859 A 10/1965 Mizell et al.
3,213,860 A 10/1965 Mizell et al.
3,223,093 A 12/1965 Winters
3,255,765 A 6/1966 Sturdivant
3,786,819 A 1/1974 Cantrell
3,805,810 A 4/1974 Savala
3,835,292 A 9/1974 Walter et al.
3,894,547 A 7/1975 Scivoletto
3,968,805 A 7/1976 Sobeck, Jr.
4,148,330 A 4/1979 Gnaga
4,177,824 A 12/1979 Gnaga
4,222,398 A 9/1980 Fromman
4,342,323 A 8/1982 Rick et al.
4,829,156 A 5/1989 Thompson
4,884,583 A 12/1989 Long, Jr.
5,119,847 A 6/1992 Powell et al.
5,133,372 A 7/1992 Seja et al.
5,323,792 A 6/1994 Caruso
5,327,919 A 7/1994 Hanlon
5,472,003 A 12/1995 Frame et al.
5,584,309 A 12/1996 De Beneditis et al.
5,771,906 A 6/1998 De Benedictis
5,813,419 A 9/1998 Brams
5,899,213 A 5/1999 Kimata
6,386,206 B2 5/2002 Lee
6,637,441 B2 10/2003 Kennedy et al.
6,647,989 B1 11/2003 De Benedictis
6,962,159 B1 11/2005 Adam
7,121,285 B2 10/2006 Kraus
7,198,049 B2 4/2007 Elmer et al.
7,305,995 B2 12/2007 Tojo et al.
7,487,783 B2 2/2009 Saito et al.
7,500,487 B2 3/2009 Kobayashi et al.
7,513,259 B2 4/2009 Kimata et al.
7,770,586 B2 8/2010 Tojo et al.
7,789,093 B2 9/2010 Tojo et al.
8,132,575 B2 3/2012 Tojo et al.
8,256,438 B2 9/2012 Tojo et al.
8,448,651 B2 5/2013 Honnefeller et al.
8,607,804 B2 12/2013 De Benedictis
8,651,118 B2 2/2014 De Benedictis et al.
8,733,374 B2 5/2014 De Benedictis et al.
8,869,808 B2 10/2014 De Benedictis
9,027,570 B2 5/2015 De Benedictis et al.
9,138,039 B2 9/2015 De Benedictis et al.
9,185,957 B2 11/2015 Richmond et al.
9,345,302 B2 5/2016 Chung
9,615,643 B2 4/2017 De Benedictis et al.
9,615,644 B2 4/2017 De Benedictis et al.
9,629,434 B2 4/2017 DeBenedictis et al.
9,788,625 B2 10/2017 DeBenedictis et al.
9,854,891 B2 1/2018 De Benedictis et al.
10,238,196 B2 3/2019 DeBenedictis
10,485,317 B2 11/2019 DeBenedictis et al.
2004/0231689 A1 11/2004 Kobayashi et al.
2004/0231690 A1 11/2004 De Benedictis
2004/0237991 A1 12/2004 Glucksman et al.
2005/0241663 A1 11/2005 Getahun
2005/0268933 A1 12/2005 Kimata et al.
2005/0284493 A1 12/2005 Allen
2006/0124148 A1 6/2006 Tojo et al.
2006/0157078 A1 7/2006 Tojo et al.
2007/0017541 A1 1/2007 Wilmore
2007/0065489 A1 3/2007 Tojo et al.
2007/0068547 A1 3/2007 Gurth et al.
2007/0084479 A1 4/2007 Ryan-Jakimas
2008/0035167 A1 2/2008 Chan
2008/0236610 A1 10/2008 Bartels
2008/0302381 A1 12/2008 Tojo et al.
2009/0056738 A1 3/2009 Tojo et al.
2010/0083978 A1 4/2010 Hottenrott et al.
2010/0170883 A1 7/2010 Legrain et al.
2010/0263684 A1 10/2010 De Benedictis
2011/0220141 A1 9/2011 Chan
2012/0186601 A1 7/2012 Ungar et al.
2013/0025621 A1 1/2013 De Benedictis
2013/0125919 A1 5/2013 De Benedictis et al.
2013/0263882 A1 10/2013 Kim et al.
2014/0076351 A1 3/2014 De Benedictis et al.
2014/0216494 A1 8/2014 De Benedictis et al.
2015/0000689 A1 1/2015 De Benedictis
2015/0114425 A1 4/2015 Park
2015/0128987 A1 5/2015 De Benedictis et al.
2015/0201727 A1 7/2015 De Benedictis et al.
2015/0216281 A1 8/2015 De Benedictis et al.
2016/0255937 A1 9/2016 De Benedictis et al.
2016/0353853 A1 12/2016 De Benedictis et al.
2017/0006989 A1 1/2017 DeBenedictis et al.
2017/0172273 A1 6/2017 Kock et al.
2018/0020796 A1 1/2018 DeBenedictis et al.
2018/0220766 A1 8/2018 De Sars et al.
2018/0228262 A1 8/2018 Bonnemaire et al.
2019/0053595 A1 2/2019 DeBenedictis

FOREIGN PATENT DOCUMENTS

EP 1417906 A1 5/2004
EP 2392222 A1 12/2011
FR 641097 A 7/1928
FR 38041 A 3/1931
FR 2310105 A1 11/1976
FR 434713 9/2011
GB 303043 A 12/1928
GB 1036583 A 7/1966
GB 1157814 A 7/1969
GB 302952 A 12/1978
GB 2413492 A 11/2005
JP S60140502 U 9/1985
JP 61-10102 U 1/1986
JP S6278801 U 5/1987
JP S633808 A 1/1988
JP 2002520076 A 7/2002
JP 2005324073 A 11/2005

(56) References Cited

FOREIGN PATENT DOCUMENTS

| | | | |
|---|---|---|---|
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

"Jan. 29, 2014 Office Action issued in U.S. Appl. No. 13/633,060 by Robyn Kieu Doan".
"Feb. 4, 2015 Notice of Allowance issued in U.S. Appl. No. 14/246,079 by Rachel Running Steitz".
"Mar. 30, 2012 Office Action in U.S. Appl. No. 12/808,646, issued by Robyn Kieu Doan".
"May 15, 2013 Office Action issued in U.S. Appl. No. 13/633,060 by Robyn Kieu Doan".
"Sep. 2012 Office Action in U.S. Appl. No. 12/808,646, issued by Robyn Kieu Doan".
"Sep. 25, 2014 Office Action issued in U.S. Appl. No. 14/246,079 by Rachel Running Steitz".
"Note: As to any co-pending U.S. applications cited herein, Applicant will provide at the examiner's request any documents desired by the examiner from the USPTO file history of any such co-pending applications."
Steenbeck, L. J., "Third Party Observations (Article 115 EPC)", Jun. 29, 2016, pp. 1-5.
"Unpublished U.S. Appl. No. 14/400,538, filed Nov. 11, 2014".
"Unpublished U.S. Appl. No. 14/490,736, filed Sep. 19, 2014".
"Unpublished U.S. Appl. No. 14/673,327, filed Mar. 30, 2015".
Van Der Scheer, Robbert, "Correspondence Concerning Investigation of Rowenta Curl Active, Model CF 6510 Product", Jun. 29, 2016, pp. 1-2.

* cited by examiner

HAIR STYLING DEVICE, HAIR STYLING METHOD AND DRIVE SYSTEM

FIELD OF THE INVENTION

This invention relates to a hair styling device, to a hair styling method, and to a drive system suitable for use in the hair styling device. The invention relates in particular to a hair waving device.

BACKGROUND TO THE INVENTION

A hair styling device is described in WO95/22920, by one of the present inventors. WO95/22920 discloses a method of styling a section (or length) of hair by inserting the section of hair into a resilient tube of latex or the like, the tube being stretched lengthwise and the ends of the tube being secured to respective parts of the section of hair. The resilient tube is allowed to contract whereupon the contained section of hair is forced into a wavy form. The hair can be treated before or after insertion into the tube so that the wavy form is maintained after the hair has been removed from the tube.

WO95/22920 also describes a device for use in the method. Improved devices for use in similar hair styling methods are described in the later applications WO97/46132, WO00/57744, WO00/08967 and WO2012/153118.

The published application WO2014/122442 describes a further improved hair styling device in which a section of hair is drawn into a styling chamber by the relative movement of driving members and forming members in the chamber. One or more driving members press the section of hair into a hair-receiving region between neighbouring forming members to create the desired wave. Heat and/or treatment products can be applied to the section of hair to set the wave. It is a particular advantage of WO2014/122442 that the driving members can be moved sequentially so that the tension applied to the section of hair is minimised.

All of the above-described documents drive a section of hair into a wavy form and can be described as hair waving devices. The present invention similarly drives a section of hair into a wavy form, and can be considered to be a further improvement upon these known hair waving devices.

Another type of hair styling device is described in each of WO2009/077747, WO2012/080751, WO2013/186547 and WO2015/132594. These documents describe devices in which a section of hair is wound around an elongate member so that the section of hair is formed into curls rather than waves.

Hair crimpers also force a section of hair into a wavy form, the crimpers comprising a pair of plates each having a series of corrugations of substantially triangular form. The plates are designed to fit together with the peaks of the corrugations of one plate fitting into the troughs of the corrugations of the other plate, and vice versa. The plates are usually heated so as to style the hair into the desired crimped form. The waves which are created by hair crimpers are typically much smaller in amplitude and wavelength than those created by the methods and apparatus of the patent documents listed above.

A "hair waver" is a product which is similar to hair crimpers in that the hair is clamped between two complementary heated surfaces. In hair wavers the complementary surfaces are usually curved with a relatively large radius of curvature so that the waves in the user's hair are considerably larger than those formed by crimpers. Particular products of this type are referred to as a "jumbo waver" or "deep waver" to emphasise the relatively large size of the waves which are produced in the section of hair.

GB303043 describes a hair waver comprising a pair of corrugated plates which are pivoted together, the peaks of the corrugations of one plate fitting into the troughs of the corrugations of the other plate whereby to clamp the hair between the plates and form the hair into waves in a first direction. Alternate corrugations of one plate are moveable longitudinally in a second direction relative to their neighbouring corrugations, and also relative to the corrugations of the other plate, the second direction being perpendicular to the first direction whereby to seek to form a more complex wave.

SUMMARY OF THE INVENTION

The inventors have conceived an alternative apparatus and method for creating waves in a section of hair, and the present invention is directed to this apparatus, and to the method of use. The apparatus and method have advantages over the known apparatus and methods as set out below. The present invention is also directed to a drive system suitable for use in a hair styling device.

According to a first aspect of the present invention there is provided a hair styling device for imparting a wave to a section of hair without clamping the section of hair in the wave form, the device having a first forming member and a second forming member, a hair-receiving region between the first forming member and the second forming member, and a driving member which is movable in a first direction relative to the first forming member and the second forming member into the hair-receiving region and which is adapted to drive the section of hair into the hair-receiving region, the driving member being movable relative to the first forming member and the second forming member also in a second direction, the second direction being at an angle to the first direction whereby to further move the section of hair in the hair-receiving region.

In common with WO2014/122442 the hair is not clamped between heated plates in the present invention. The inventors have found that avoiding any clamping of the hair allows the hair to form waves with a more natural curve which can produce a more aesthetically pleasing wave. Also, the likelihood of damage to hair is known to increase if the hair is heated to a styling temperature and clamped at the same time, so the avoidance of any clamping significantly reduces the likelihood of damage.

WO2014/122442 discloses arrangements in which the driving members move into the hair-receiving regions in a single stage of movement, and specifically in the first direction; the driving members do not also move in a second direction to further move the section of hair in the hair-receiving regions. In the arrangement of FIGS. 23-27 in particular, the driving member is a spiral with a continuous (rotational) movement, the increasing radius of the spiral pressing the section of hair (downwardly as viewed) into the hair-receiving regions in a single direction of movement.

The movement of the present driving member in two stages and in two different directions, and the consequential pressing of the section of hair into the hair-receiving region in two different directions, provides a three dimensional wave, such a wave being aesthetically desirable to many users. A three dimensional wave is envisaged in WO2014/122442 and an alternative arrangement to FIGS. 12-18 is disclosed in which the sides of the driving members and forming members are oppositely angled to promote a three-dimensional wave. That embodiment relies upon the section of hair moving laterally as it engages the angled sides, and is not as reliable or repeatable as the present invention which positively drives the section of hair into a three-dimensional form by virtue of the two stage movement of the driving member in two different directions.

Preferably, the movement of the driving member is linear in the first direction and/or in the second direction. The second direction can be substantially perpendicular to the first direction so that the driving member can initially press the section of hair directly into the hair-receiving region and can subsequently move the section of hair directly along the hair-receiving region.

It will be understood that perpendicular movements of the driving member are not necessary and in practical embodiments there can be an acute angle between the first and second directions of movement of the driving member. It is nevertheless expected that embodiments in which there is an acute angle between movements in the first and second directions will be mechanically simpler than embodiments in which the first and second directions are perpendicular.

It is not intended that there is any pause in the movement of the driving member between the first and second stages, although that is not excluded. Also, it is expected that in practical devices there will not be a defined junction between the movements in the first direction and the second direction, and on the contrary it is expected that the driving member will move along a curved path joining the first stage movement in the first direction and the second stage movement in the second direction. In practical embodiments therefore it may not always be possible to determine precisely where the first stage of movement terminates and the second stage of movement commences, but it will nevertheless be possible to identify two stages of movement in two different directions.

Preferably, the hair-receiving region is in the form of an elongate channel or slot and the first and second forming members are elongated in the direction of the longitudinal axis of the channel (the forming members being in the form of rails or beams for example). During the first stage of movement the driving member can move into the channel and during the second stage of movement the driving member can move along the channel. The driving member can also be of elongate form, e.g. a rail or beam.

In WO2014/122442 the hair-receiving regions have a relatively small dimension in the direction perpendicular to the first direction. The hair-receiving regions are not required to be in the form of channels (or otherwise elongate) since unlike the present invention they are not required to accommodate any significant movement of the section of hair in the second direction.

In its simplest form the device comprises only two forming members and a single driving member and can impart a single wave into the section of hair. In a preferred embodiment, however, there are multiple forming members defining multiple hair-receiving regions, and multiple driving members, so as to impart multiple waves into the section of hair. Preferably, a hair-receiving channel is provided between each pair of neighbouring forming members.

In embodiments having multiple driving members, it is preferably arranged that the driving members move sequentially so as to minimise the tension applied to the section of hair as it is deformed by the driving members. The first driving member can stop moving in the second direction before the second driving member is moved in the first direction, although some overlapping movement of the driving members may be provided (and overlapping movement is preferred for those embodiments utilising the disclosed drive system). The absence of clamping of the section of hair enables the hair to move in the hair-receiving regions with a minimum of resistance as successive driving members cause the section of hair to deform.

Preferably, one or more parts of the device are heated whereby to heat the section of hair during the waving process. Whilst the use of an external hair dryer is not excluded, the direct heating by way of electrical heating elements or the like mounted to the device is preferred. For example, some or all of the forming members (and also some or all of the driving members, as applicable) can contain electrical heating elements.

Desirably, a chamber is provided to contain the section of hair during the waving process. In such embodiments the forming and driving members are located in the chamber. Also in such embodiments one or more of the walls of the chamber may be heated by way of respective electrical heating elements.

One embodiment of the device has a body and a closure part or lid, the closure part being movable relative to the body between an open position in which a section of hair can be introduced into the device, and a closed position in which the chamber is substantially closed. It can be arranged that the proximal (or scalp) end of the section of hair is clamped when the closure part is in its closed position, this being possible since the proximal end of the section of hair does not usually need to move relative to the device during the styling operation. Nevertheless, it is preferred that the proximal end (as well as other parts of the section of hair which are not to be styled) will not be clamped by the device. Preferably, the (movable) driving member(s) are mounted to the body and the (fixed) forming members are mounted to the closure part. Preferably also, the control mechanism for the driving member(s) is mounted in the body.

Preferably, in embodiments having multiple driving members, a hair-receiving region is also provided between each pair of adjacent driving members, and the forming members therefore effectively act also to drive or press the section of hair into the hair-receiving region(s) between adjacent driving members. The term "driving member" is used herein to describe the movable hair-deforming component and the term "forming member" is used to describe the non-movable or fixed hair-deforming component (where movement is considered relative to the body of the device). This does not preclude the possibility that both of the driving member(s) and forming members are movable relative to a body of the device, although such embodiments are likely to be significantly more mechanically complex.

In common with WO2014/122422, the provision of a chamber with a closure part serves four main purposes. Firstly, in embodiments in which the chamber is heated the closure part can reduce the loss of heat by way of convection through the hair-entry opening. Secondly, in those embodiments in which the chamber is heated, the closure part can reduce the likelihood of the user touching a heated surface of the device. Thirdly, the closure part can reduce the likelihood of extraneous hair being engaged by the moving components in the chamber which might otherwise cause entanglement and/or discomfort to the user. Fourthly, if a hair-treatment product is used to help style a section of hair, a substantially closed chamber can reduce the amount of (vaporised) product which escapes into the environment.

Desirably, the forming members have a curved surface around which the section of hair bends as it is deformed during operation of the device. Desirably also, the driving member(s) have a curved surface which is engageable with the section of hair during use. The provision of curved surfaces assists the sliding of the hair past the forming members and driving member(s) as the wave is formed, and thereby minimises the tension in the section of hair as it is being deformed by the driving member(s).

In some embodiments there are between three and ten forming members and one fewer driving member. In a preferred embodiment there are five driving members and six forming members, each neighbouring pair of forming members providing a hair-receiving region into which (and along which) a respective driving member can move.

It will be understood that, during the first stage of movement, each driving member moves from its start or rest position in the first direction to an intermediate position, and then, during the second stage of movement, in the second direction to a limit or extreme position. The distance between the start position and the limit position largely determines the length of the section of hair in each of the waves produced by the device. Accordingly, the largest deformation of the section of hair occurs when the driving member is in its limit position. There are of course further stages of movement in each cycle of operation during which the driving member moves back to the start position, but the terms two-stage movement, first stage and second stage refer herein to movements of the driving member which increase the deformation in the section of hair, i.e. to movements of the driving member towards the limit position.

In some embodiments the length of the section of hair in each wave can be varied by allowing adjustment (by the user) of the limit position, for example adjustment of the distance by which the driving member moves in the second direction.

It will be understood that the natural resilience of hair will cause the section of hair to tend to relax after the driving member(s) have stopped moving upon reaching their limit position, i.e. the individual hairs in the section of hair will seek to straighten out and thereby soften any sharp corners through which the hairs have been bent. The degree to which the section of hair will relax is determined partly by the user's hair type, partly by the temperature to which the section of hair is heated, and partly by whether the user's hair is wet or dry (amongst other factors). The inventors have realised that it is desirable to permit the hair to relax as that creates softer curves in the section of hair and a more natural looking wave. Thus, whilst the wave could be set with the driving member(s) in the limit position, that is likely to create a wave with sharp curves and a less-aesthetically pleasing appearance. The inventors prefer not to rely upon the (unreliable and variable) tendency of the hair to relax, and instead assist the relaxation of the hair by optionally retracting the driving member(s) away from the limit position before the wave is set.

Alternatively stated, it will be understood that in addition to the above factors, the ability of the hair to relax into a more natural looking wave is in part limited by the resistance to movement of the section of hair relative to the driving and forming members; by retracting the driving member(s) away from the limit position the engagement between the driving member(s) and the section of hair is reduced (or perhaps eliminated), and the tension in the section of hair is reduced, both of which increase the ability of the section of hair to relax into a more natural looking wave in the hair-receiving region.

According to a second aspect of the present invention there is provided a hair styling device for imparting a wave to a section of hair, the device having a first forming member and a second forming member, a hair-receiving region between the first forming member and the second forming member, and a primary driving element which is movable relative to the first forming member and the second forming member and which is adapted to move the section of hair in the hair-receiving region in a hair-deforming direction, the device having a secondary driving element which is movable relative to the first forming member and the second forming member and which is adapted to move the section of hair in the hair-receiving region in a direction opposed to the hair-deforming direction.

WO2014/122442 discloses arrangements in which driving elements move into the hair-receiving regions in a hair-deforming direction; there are, however, no secondary driving elements adapted to drive the section of hair in a direction opposed to the hair-deforming direction. In the arrangements of FIGS. 23-27 and FIGS. 28-32 in particular, the driving elements enter into and then reverse out from the hair-receiving regions and that permits the section of hair to relax in the hair-receiving regions. The inventors have found, however, that it is preferable to positively drive the section of hair into a more relaxed position so as to make the softening of the wave more reliable and repeatable (and more uniform if multiple waves are formed along a section of hair).

As above described, the inventors have found that crimpers and hair wavers do not create the most natural looking and aesthetically pleasing waves because the hair is clamped as it is being styled. On the contrary, the appearance of the wave created by the present invention is enhanced by allowing the section of hair to relax into a space in which it can adopt its most natural curvature, ideally free of any tension or clamping. Accordingly, whilst the section of hair is initially driven by the secondary driving element to a more relaxed position, it can be arranged that the secondary driving element releases the hair in that more relaxed position, so that the final curvature of the section of hair is determined primarily by the hair itself rather than by surfaces of the device.

According to a third aspect of the invention there is provided a method of styling a section of hair with a device having a first forming member and a second forming member, a hair-receiving region between the first forming member and the second forming member, a primary driving element which is movable relative to the first forming member and the second forming member, and a secondary driving element which is movable relative to the first forming member and the second forming member, the method comprising the steps of:

{i} moving the primary driving element relative to the first and second forming members to move the section of hair in the first hair-receiving region in a hair-deforming direction, {ii} moving the secondary driving element relative to the first forming member and the second forming member to drive the section of hair in the hair-receiving region in a direction opposed to the hair-deforming direction.

The primary and secondary driving elements may move together relative to the first and second forming members. In step {i} the primary driving element may move in the hair-deforming direction to a limit position; in step {ii} the secondary driving element may move in the reverse direction to a retracted position, or alternatively back to the start position.

It is preferably arranged that the wave is not set in the section of hair until the secondary driving element has undertaken the (reverse) movement and the wave has been driven into the more relaxed position. In embodiments in which the wave is set by the application of heat it can be arranged that the desired operating temperature is not reached until after the secondary driving element has completed the reverse movement. The preferred sequence of operations is therefore to drive the section of hair in the hair-receiving region in the hair-deforming direction, to drive the section of hair in the hair-receiving region in the reverse direction into a more relaxed position, and then to set the wave.

Ideally, the section of hair is released from the secondary driving element (and also from the primary driving element) before the wave is set.

In embodiments combining the first and second or the first and third aspects, the primary and secondary driving elements can be carried by a driving member. Also, the secondary driving element can be adapted to drive the section of hair in a reverse direction opposed to the second direction.

The secondary driving element can itself move in the reverse direction, or it can move along a more complex path with a component of movement in the direction opposed to the hair-deforming direction. Similarly, the section of hair can be driven by the secondary driving element along a path with a component of movement in the direction opposed to the hair-deforming direction. Accordingly, it is recognised that the invention according to the second and third aspects does not require the section of hair to be driven directly in the direction opposed to the hair-deforming direction; provided that the secondary driving element has at least a component of movement in the direction opposed to the hair-deforming direction it will permit the section of hair to move at least partly in that direction and thereby relax into a more natural looking wave.

Preferably the primary and secondary driving elements are connected to move together, ideally being parts of a unitary component. In embodiments in which the primary and secondary driving elements move together in the reverse direction opposed to the hair-deforming direction, movement of the primary driving element in the reverse direction releases the section of hair allowing it to relax, and movement of the secondary driving element in the reverse direction drives the section of hair to a more relaxed position.

In some embodiments the device has a defined (retracted) position to which the secondary driving element is reversed in the direction opposed to the hair-deforming direction. Preferably, however, the secondary driving element reverses fully, i.e. it moves all the way back to the start position, before the wave is set. In embodiments having multiple primary driving elements and multiple secondary driving elements, ideally all of the secondary driving elements move together to the retracted or start position, it being recognised that there is little or no tension upon the section of hair during this part of the driving elements' movement.

According to a fourth aspect of the present invention there is provided a hair styling device for imparting a wave to a section of hair without clamping the section of hair in the wave form, the device having a first forming rail and a second forming rail, a hair-receiving channel between the first forming rail and the second forming rail, and a driving rail which is movable in a first direction between a position outside the hair-receiving channel and a position in the hair-receiving channel, the first driving rail also being movable in a second direction along the hair-receiving channel.

The terms "channel" and "rail" are used to clarify the elongate form of the respective components according to this aspect of the invention, but are otherwise not limiting to the form of those components.

Whilst the embodiments of WO2014/122422 are shown and described imparting a wave to a section of hair comprising a small bundle, the invention according to this aspect is suited primarily to impart a wave into a ribbon-like section of hair. Whilst the terms "bundle" and "ribbon" are not precisely defined, they are distinguished herein in that a bundle has a similar width and depth whereas a ribbon has a much greater width than depth. In particular, the provision of an elongate channel and elongate forming rails and driving rail(s) allows the user to style a greater volume of hair by spreading the hair into a ribbon along and across the rails.

Preferably, the driving rail(s) has a number of upstanding driving elements or pegs. The pegs separate the section (ribbon) of hair along the rails and help to ensure that the individual hairs remain in position between adjacent pegs as the driving rail moves along the hair-receiving channel. Without the pegs the individual hairs in the section of hair might slide along the rails as the driving rail is moved, reducing the length of hair in each wave created by the device. The provision of upstanding pegs helps to ensure that the length of hair in each of the waves is more reliable and controlled. In addition, the provision of raised pegs helps to ensure that all of the individual hairs in the section of hair are deformed into a similar wave form (without the pegs the individual hairs in a less densely packed part of the ribbon might slide along the rails more than the individual hairs in a more densely packed part of the ribbon, resulting in a non-uniform wave across the ribbon).

Desirably, at least one of the forming rails has a number of upstanding forming elements or pegs, which provide similar benefits to the upstanding driving elements set out above. Desirably also, the driving elements or pegs of the driving rail overlap the forming elements or pegs of the forming rail(s) when the closure part of the device is closed. Accordingly, as the closure part is closed the overlapping pegs cause the section or ribbon of hair to be separated into smaller sections prior to movement of the driving member(s), the subsequent position of each smaller section of hair being largely controlled during movement of the driving member(s) by the pegs.

Unlike GB303043 the hair is not clamped in the wave form. Also, in the preferred embodiments having multiple forming members and multiple driving members, all of the driving members of the device are moved along the respective hair-receiving channel.

It will be understood that all of the pegs of a particular driving rail move together. In embodiments combining the second and fourth or third and fourth aspects of the invention one peg can be the primary driving element and an adjacent peg can be the secondary driving element for a particular section of hair.

According to a fifth aspect of the present invention there is provided a hair styling device for imparting a wave to a section of hair without clamping the section of hair in the wave form, the device having a first forming member and a second forming member, a hair-receiving region between the first forming member and the second forming member, and a driving member which is movable relative to the first forming member and the second forming member and which is adapted to drive a section of hair into the hair-receiving region, the device having a chamber for retaining the section of hair, the chamber being heated by way of at least one electrical heating element, the device having an airflow generator configured to drive ambient air into the chamber, the device having a controller to control the operation of the heating element(s) and the airflow generator, the controller being configured to heat the section of hair to a first temperature and then to cool the section of hair to a second temperature during operation of the device, the second temperature being above ambient temperature and below the first temperature.

The device according to this aspect provides a dual temperature regime for the section of hair, the first (high) temperature being at a level suitable for the creation of waves in the section of hair, the second (low) temperature being at a level substantially to set the created waves and also to reduce the likelihood of the user being burned if heated surfaces are touched.

Thus, it is recognised that the section of hair will more quickly be styled into the desired wave with the application of heat, typically around 200° C. It is also recognised that some of the wave will be lost if the section of hair remains at such an elevated temperature when it is removed from the device. Cooling the section of hair before it leaves the device will reduce the loss of wave which might occur. Cooling the section of hair will also reduce the temperature of the components of the device which might inadvertently be touched by the user, thereby reducing the likelihood of burns. The second temperature can still be relatively hot, however, for example around 100° C., so that the time taken (and energy required) to subsequently re-heat the components and the next section of hair is significantly reduced.

The use of a dual temperature regime takes advantage of the fact that hair is relatively resilient at ambient and low temperatures, but becomes softer and more malleable at higher temperatures. For many hair types the hair will become soft enough to deform into a wave at around 200° C., but it is recognised that different hair types will require different temperatures. Also, there is a trade-off between temperature and styling duration, and typically a lower styling temperature can be used with the hair held in its deformed position for longer, or a higher styling temperature can be used and the hair held for a shorter period, as desired. Heating the hair to a first temperature of around 200° C. can enable relatively quick styling of the section of hair. Subsequently cooling the hair to a second temperature well below 200° C., before the hair is released from the device, will reduce the loss of curvature which might otherwise occur.

In embodiments combining the fifth aspect with other aspects of the invention, it is preferably arranged that the driving member(s)/rail(s) are reversed to their retracted or start positions before the first temperature is reached. Maintaining the section of hair at a cooler temperature as it is being deformed by the moving driving member(s) is desirable so that the hair has greater resilience and will more readily relax into a natural looking wave when released from the driving member(s).

According to a sixth aspect of the invention there is provided a drive system suitable for use in a hair styling device for imparting waves into a section of hair, the drive system having at least three driving rails, each driving rail being mounted adjacent to a guard rail, each of the driving rails having a drive mechanism configured to move the driving rail relative to the guard rail from a start position to a limit position and back to the start position, the drive system being configured to move the first driving rail to its limit position before the second driving rail is moved to its limit position and to move the second driving rail to its limit position before the third driving rail is moved to its limit position, the drive mechanism of the second driving rail being configured identically to the drive mechanism of the third driving rail, the drive mechanism of the first driving rail being configured identically to the drive mechanism of the second driving rail except for an initiating element adapted to initiate movement of the first driving rail away from its start position, a single drive motor acting to move at least the second and third driving rails from their start positions to their limit positions.

Preferably, at least the first and second driving rails are temporarily securable in their limit positions by respective latch mechanisms. In such arrangements, the drive system incorporates latch release mechanisms whereby the first and second driving rails are released to move from their limit positions to their start positions.

In some embodiments the third driving rail is not temporarily securable in its limit position. Preferably, movement of the third driving rail towards its limit position actuates the latch release mechanisms for the first and second driving rails. In such arrangements the drive system is configured to that, as the third driving rail approaches its limit position, it releases the first and second driving rails so that all of the driving rails can be moved back to their start positions (preferably simultaneously).

In alternative embodiments the latch release mechanism may include one or more solenoids (for example) acting directly upon the latch mechanisms, or a second motor acting indirectly upon the latch mechanisms by way of a latch release cam.

Desirably, the drive system has means to temporarily secure each of the driving rails in their start positions. Preferably, each drive mechanism has a first latching element to temporarily secure its driving rail in the start position, and a second latching element to temporarily secure its driving rail in the limit position.

The initiating element can be a solenoid or the like configured to drive the first driving rail away from its start position. Alternatively, the initiating element can be a part of the first driving rail which is driven by the single drive motor whereby the single drive motor acts to move all of the driving rails from their start positions to their limit positions. Alternatively again, the initiating element can be driven by a separate motor which acts to move the first driving rail indirectly (by way of an initiating cam for example).

Desirably, the drive mechanism of the first driving rail interacts with the drive mechanism of the second driving rail whereby movement of the first driving rail initiates movement of the second driving rail, and so on for the third and successive driving rails. Preferably, movement of the second driving rail is initiated as the first driving rail approaches its limit position, and so on for the third and successive driving rails.

Preferably, each of the drive mechanisms has a pinion which is fixed in position relative to the guard rail, and a rack for the driving rail. Desirably, the pinion of the drive mechanism for at least the second and third driving rails does not engage the respective rack when the driving rail is in its start position and in its limit position, whereby rotation of the pinion causes no movement of the second and third driving rails in those positions. Accordingly, some (initiating) movement of the second and third driving rails is required in order to move the respective rack from its start position into engagement with the pinion. As above indicted, it is preferably arranged that movement of the first driving rail initiates movement of the second driving rail, and subsequent movement of the second driving rail initiates movement of the third driving rail (and so on for the subsequent driving rails).

Preferably, movement of the second driving rail is initiated only shortly before the first driving rail reaches its limit position (and similarly for the third and subsequent driving rails). Thus, whilst there is some overlap in the movement of the first and second driving rails (and similarly some overlap in the movement of the second and third driving rails), the overlap is small so that the tension in the section of hair is minimised. It is in particular desired that the overlap is sufficiently small that the first driving rail has reached (and is temporarily secured in) its limit position before the third driving rail moves from its start position.

The present application describes two alternative drive systems for a hair styling device. In both drive systems, following initiating movement of the first driving rail, a single drive motor moves all of the driving rails to their limit positions sequentially. All of the driving rails are temporarily secured in their limit positions by (optional) latch mechanisms. In the described drive systems a second motor is provided to drive the initiating element of the first driving rail, the second motor also actuating the latch release mechanism so that the driving rails can be driven back to their start positions. Minimising the number of motors can reduce the weight and cost of the hair styling device. The invention according to other aspects is not, however, limited to the use of these particular drive systems, nor by the number of motors used in the drive systems.

The preferred and desirable features for each aspect of the invention may be combined or shared with those other aspects of the invention with which they are compatible.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
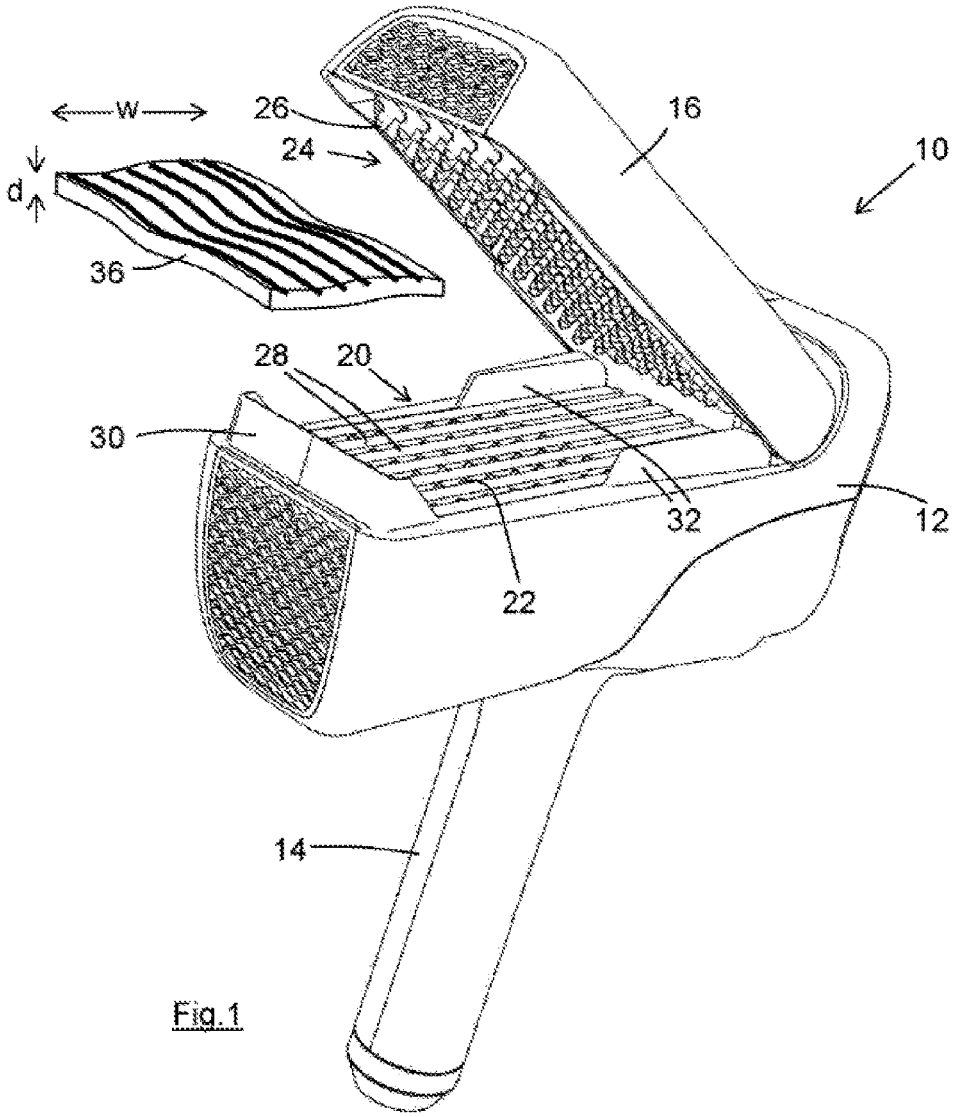
FIG. 1 shows a perspective view of a first embodiment of hair styling device according to the present invention, in its open condition.

The hair styling device 10 comprises a body 12 with an integral handle 14. Connected to the body 12 is a closure part or lid 16. In this embodiment the closure part 16 is pivotably mounted to the body 12, but in other embodiments other mounting means for the closure part are used. Also, in this embodiment the closure part 16 is moved automatically, i.e. by way of a motor (not shown) as part of the sequence of operations of the device 10. In another embodiment the closure part is biased to its open position by a spring and is closed manually by the user, the closure part being held in its closed position by a latch which is automatically released at the end of the styling operation.

The body 12 carries a number of movable driving members or rails 20 (as better seen in FIGS. 6-10). In this embodiment there are six driving rails 20 but in other embodiments there are more or fewer driving rails as desired. Each of the driving rails 20 has a series of raised driving elements or pegs 22 (as better seen in FIGS. 6 and 8-10). The driving rails 20 are in their start or rest positions in FIG. 1 and only the tips of the pegs 22 are visible.

The closure part 16 carries a number of forming members or rails 24. In this embodiment there are seven forming rails 24, i.e. one more than the number of driving rails 20. Each of the forming rails 24 has a series of raised forming elements or pegs 26, some of which are better seen in FIGS. 8-10.

Figure 2:
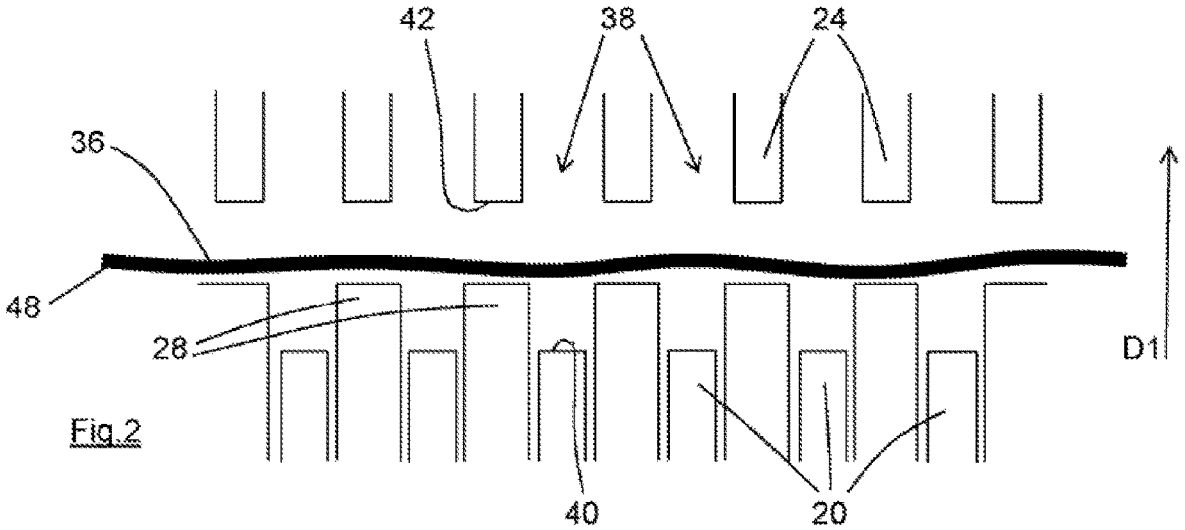
FIG. 2 represents the forming rails and driving rails of the device shown in FIG. 1.

A fixed guard rail 28 is located to each side of each of the driving rails 20. The guard rails 28 are separated by a distance only slightly greater than the thickness of the driving rails 20 so that the driving rails 20 can slide between the neighbouring guard rails 28 whilst minimising the likelihood of hair entering between a guard rail 28 and a driving rail 20 where it might become trapped. As shown in the representation of FIG. 2, the forming rails 24 are aligned with the guard rails 28, so that the driving rails 20 are offset from the forming rails 24. As is also shown in the representation of FIG. 2, the forming rails 24 are significantly narrower than the guard rails 28 so that the section of hair 36 can readily slide between the driving rails 20 and forming rails 24 when the driving rails have moved into the hair-receiving regions 38 between the forming rails 24 as explained below.

The body 12 has an end guide 30 and two side guides 32. It will be understood that when the closure part 16 is moved (pivoted) to its closed position only a small hair entry gap remains at each side of the device 10, with the closure part 16 defining the top of the gap, the body 12 defining the bottom of the gap, and the guides 30 and 32 defining the opposing sides of the gap. The closure panel 16 can therefore largely enclose a chamber within which the driving rails 22 and forming rails 24 are located and within which a section of hair can be styled as described below. The hair entry gap is large enough to permit hair to pass therethrough and the closure part 16 does not clamp any part of the hair against any part of the body 12 during use.

The section of hair 36 which is to be styled is shown schematically in FIG. 1 approximately in the orientation in which it will be introduced into the device 10. Thus, the chosen section of hair 36 is oriented across the device as shown, and positioned between the body 12 and the closure part 16, and also between the opposing guides 30 and 32. It will be seen that the guides 30 and 32 are tapered to assist the user in correctly positioning the section of hair 36 between the guides.

The device could have movable guide parts such as those described in WO2013/186547 in order to prevent the user from inadvertently positioning the section of hair 36 beyond the gap between the guides 30 and 32 (see also the movable guide parts of the second embodiment 210 described below).

The section of hair 36 shown in FIG. 1 is in the form of a "ribbon", i.e. it has a much greater width w than its depth d. Such a section of hair maximises the utility of the device 10, but the device can if desired be used to style a "bundle" of hair, i.e. a section having a similar depth and width (or perhaps being approximately circular with a diameter somewhat less than the dimension w). Whilst it is desirable that the user spreads the chosen section of hair into a ribbon form as shown in FIG. 1, it will be understood that a bundle of hair will in any event be driven to spread out along the rails 20, 24 as the closure part 16 is moved to its closed position, so that significant latitude in the configuration of the section of hair presented to the device 10 is available to the user.

FIG. 2 represents a cross-section through a part of the device 10, and is provided to show the array of seven forming rails 24 and six driving rails 20, in the condition in which the closure part 16 has been moved to its closed position. FIG. 2 does not show the pegs 22, 26 so as to distinguish from the representations of FIGS. 3-5, i.e. FIG. 2 represents a cross-section between adjacent pegs for the driving rails 20 and the forming rails 24.

FIG. 2 represents the start position of the driving rails 20, as is also seen in FIG. 1. In that position the tips of the pegs 22 lie close to the top surface of the guard rails 28, and the linear edges 40 of the driving rails 20 which lie between neighbouring pegs 22 (and which linear edges are shown in FIG. 2 and also in FIGS. 3-5) are located some distance below the top surface of the guard rails 28. The spacing between the guard rails 28 and driving rails 20 is exaggerated in FIG. 2 for clarity, and as stated above in practice each driving rail 20 is a close sliding fit between the neighbouring guard rails 28 so as to minimise the likelihood that hair will enter between a driving rail and a guard rail.

Figure 3:
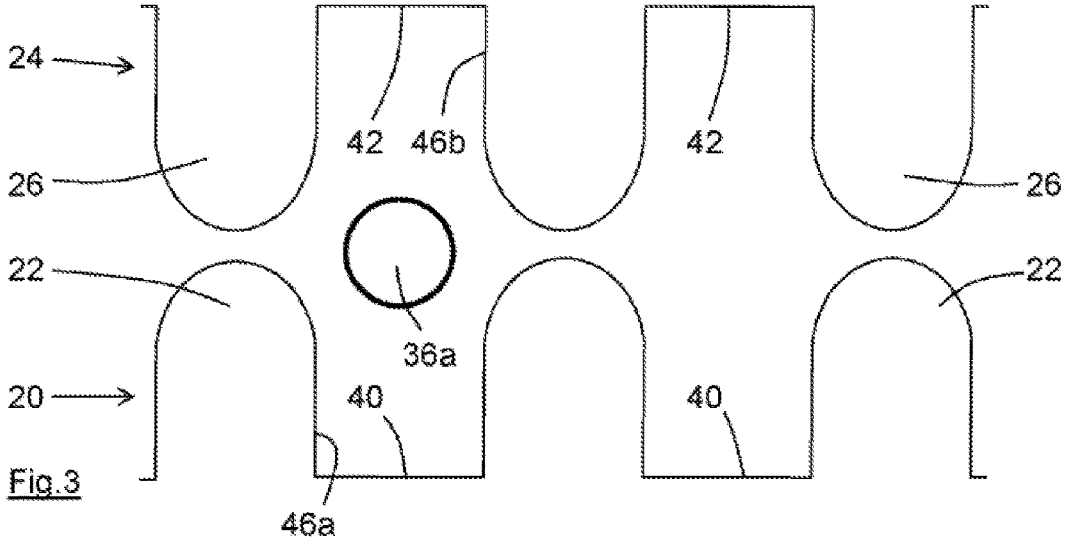
FIGS. 3-5 represent the sequence of operations for the driving rails and forming rails for the purpose of explaining the operation of the device of FIG. 1.
Figure 4:
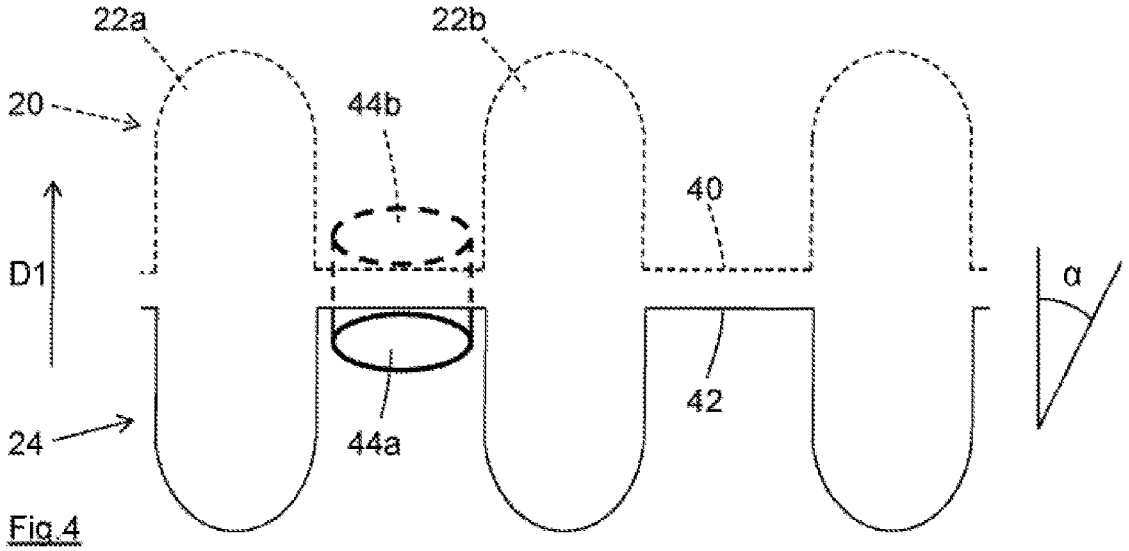
Figure 5:
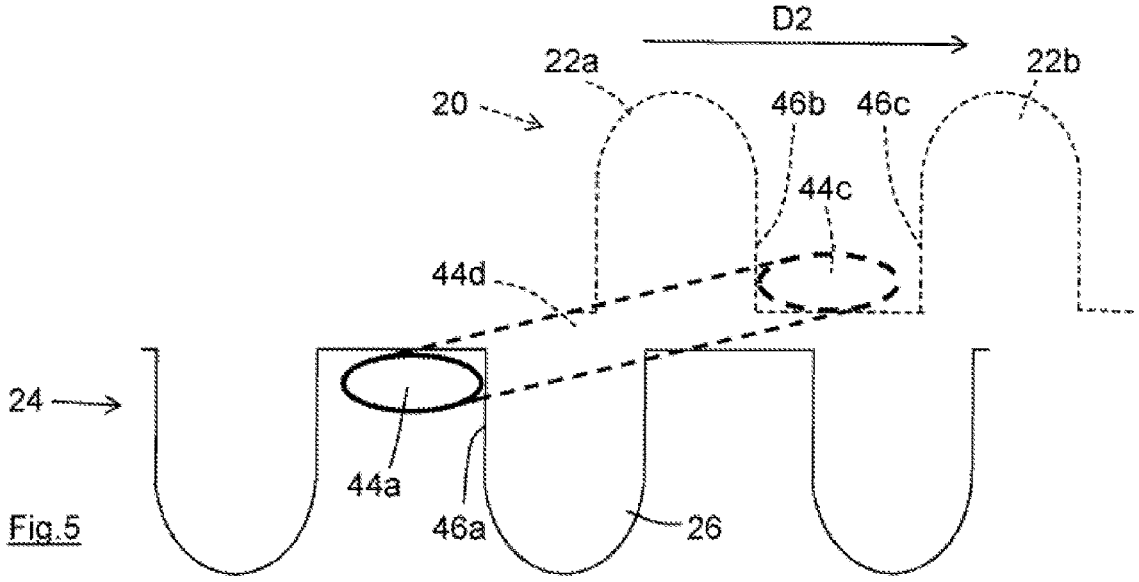

FIG. 2 also shows the driving rails 20 and forming rails 24 as being square-cornered, primarily to distinguish from the rounded pegs which are shown in FIGS. 3-5. In practice the corners of the driving rails 20 and forming rails 24 will preferably be rounded so as to avoid the hair being forced to bend around a sharp corner as it is deformed into a wave.

Whilst the pegs 26 of the forming rails 24 are not shown in FIG. 2, it will be understood that they project (downwardly as drawn) towards the guard rails 28. It can be arranged that there is a small gap between the tips of the pegs 26 and the guard rails 28 when the closure part 16 is in its closed position, and this is preferred so as to avoid the possibility that hair can become inadvertently trapped between a peg and guard rail, notwithstanding that the tips of the pegs 26 are rounded so as to minimise the likelihood that hair will become trapped.

The pegs 22 of the driving rails 20 are also not shown in FIG. 2, and it will be understood that the pegs 22 project (upwardly as drawn) towards the hair-receiving regions 38 between adjacent forming rails 24. It is preferably arranged that when the closure part 16 is in its closed position, the pegs 22 overlap slightly with the pegs 26, and both sets of pegs engage the length of hair 36. This has the effect of separating the ribbon or section of hair 36 into separate smaller sections (such as the separate smaller section **36*a* represented in FIG. 3) as the closure part 16 is closed. Because the driving members 20 are out of alignment with the forming members 24**, there is no danger of the hair becoming clamped or trapped between the overlapping pegs.

It will be understood that the section of hair 36 is laid between the driving rails 20 and forming rails 24 in the same manner as described in WO2014/122442, i.e. across the page from left to right as drawn in FIG. 2. When the device is operated, the driving rails 20 move in a first direction D1, i.e. upwardly as drawn in FIG. 2, each driving rail 20 moving into a hair-receiving channel 38, and driving the section of hair 36 into the respective hair-receiving channels 38 to adopt a wavy form.

FIGS. 3-5 represent a part of a single driving rail 20 and a corresponding part of a single forming rail 24, in side view, i.e. perpendicular to the end view of FIG. 2. In particular, the direction of view for FIGS. 3-5 is from the right-hand side of FIG. 2, looking substantially along the length of the individual hairs in the section of hair 36.

FIG. 3 represents the start position of the driving rail 20. FIG. 4 represents the intermediate position after the driving rail 20 has completed its movement in the first direction D1. FIG. 5 represents the limit position after the driving rail 20 has completed its movement in the second direction D2.

For ease of understanding, FIG. 3 shows the pegs 22 and 26 as not overlapping in the start position, although as above described it is preferable for them to do so in practice. As explained above, overlapping pegs 22, 26 have the effect of separating the section of hair 36 into a number of smaller sections **36*a* as the closure element 16 is moved to its closed position. Notwithstanding that the pegs 22, 26 are shown as not overlapping in FIG. 3, one of the resulting smaller sections of hair 36*a* is represented in that figure. It will be understood that the section of hair 36 will in practice be separated into several smaller sections 36*a* between neighbouring pairs of pegs 22, 26, and that the smaller sections 36*a* are generally kept separate by the pegs 22, 26 during the styling operation. To explain the operation of the device it is necessary only to explain the formation of a wave in one of the smaller sections of hair 36*a* in one of the hair receiving regions 38**, it being understood that the formation of a wave in the other hair receiving regions, and in the other smaller sections of hair, is similar.

The first stage of movement of the driving rail 20 is upwardly (and linearly) in the first direction D1 to the position as drawn in FIG. 4. During the first stage of movement, the driving rail 20 enters the aligned hair-receiving channel 38 which is behind the forming member 24 as drawn; the pegs 22 of the driving rail 20 move past and beyond the pegs 26 of the forming member 24.

Between each neighbouring pair of pegs 22 the driving member 20 has a linear edge 40 and between each neighbouring pair of pegs 26 the forming member 24 has a linear edge 42. During the first stage of movement the linear edges 40 move past and beyond the linear edges 42.

The separate sections of hair **36*a* between each pair of neighbouring pegs 22, 26 are therefore forced into a one-dimensional wave form. The portion 44*a* of the smaller section of hair 36*a* passes under the linear edge 42 of the forming rail 24 and the portion 44*b* of the smaller section of hair 36*a* passes over the linear edge 40 of the neighbouring driving rail 20, similarly to the operation described in WO2014/122442. FIG. 4 shows the smaller section of hair 36*a* being pressed from the circular cross-sectional shape into a more flattened cross-sectional shape as it is deformed into a wave (although the actual shape of the smaller sections of hair 36***a* will likely be more complex in practice).

The second stage of movement of the driving rail 20 is also linear and to the right as drawn, in the second direction D2, to the limit position as represented in FIG. 5. During this stage of movement, the driving rail 20 moves along its hair-receiving channel 38 between neighbouring forming members 24. The separate smaller sections of hair 36*a* are therefore further deformed as represented in FIG. 5. In particular, the smaller section of hair 36*a* is further deformed into a wave in the second direction D2, with the portion 44*a* being restrained by its engagement with the side 46*a* of the peg 26 whilst the portion 44*c* is driven in the direction D2 by its engagement with the side 46*b* of the peg 22*a*.

Whilst only one of the separate smaller sections of hair 36*a* is represented in FIGS. 3-5, it will be understood that a similar smaller section of hair is located between other (and perhaps all of the) pegs 22, 26 along the driving and forming rails 20, 24; the pegs 22, 26 thereby ensuring that each of the separate smaller sections of hair is deformed to substantially the same extent, producing a uniform wave for the whole ribbon of hair 36. It will be understood that the deformation is substantially uniform regardless of the number of individual hairs in the separate smaller sections 36*a*, so that the user does not need to ensure that the section of hair 36 has a consistent depth d or width w, nor that the sections of hair which are successively styled by the device are of consistent size.

The length of hair in each of the waves which are produced in the section of hair 36 is determined primarily by the length of the substantially linear portions 44*d* between the portions 44*a* and 44*c* in the limit position of FIG. 5 (the length of hair in each wave being approximately double the length of the substantially linear portions 44*d*). The length of the substantially linear portions 44*d* is determined largely by the distance through which the forming members 20 move in the second direction D2. In the representation of FIG. 2 the forming member 20 moves in the second direction D2 by a distance slightly greater than the spacing between two adjacent pegs 22 but in practice the forming member 20 will move significantly further than represented in FIG. 2, for example by a distance around five or six times the spacing between neighbouring pegs. It is expected that the movement of the driving members 20 in the direction D2 will far exceed the movement in the direction D1 in the commercial embodiments of the device.

The section of hair 36 is therefore firstly separated into smaller sections 36*a*, and the smaller sections of hair are then driven into a wave form in two different directions.

Whilst FIGS. 3-5 represent the driving rail 20 as moving in two perpendicular directions D1 and D2, it will be understood that this is not necessary. Whilst it is mechanically straightforward to move the driving rail 20 in the second direction D2, i.e. along the hair-receiving channel 38 (as is explained in the drive mechanisms below), it is more mechanically difficult to move the driving rail 20 in the perpendicular direction D1 of FIG. 4. Instead, therefore, as in the drive mechanisms described below, the driving rail 20 preferably moves from its start position to its intermediate position at an acute angle α. Despite the angled movement, the driving member 20 during its first stage of movement has a component aligned with the perpendicular direction through which it moves into the hair-receiving channel 38, and that component of movement causes the section of hair to be pressed into the hair-receiving channel as required. Also, the pegs 22,26 can maintain the separation of the smaller sections of hair 36*a* despite the angled first stage of movement of the driving members 20.

It will be appreciated that in embodiments according to some aspects of the invention the driving member can have a single stage of movement, for example in the direction α. That is not preferred, however, as it has been found that waves of larger amplitude, and with a more pleasing appearance, can be created by a two-stage movement, and with a relatively large movement in the second direction D2.

It will be understood from FIG. 1 that initially only a relatively small proportion of the total length of the section of hair 36 lies within the device 10 in its start position. During the first stage of movement the relatively linear hairs shown in FIG. 2 are deformed into a wave form, which has the effect of drawing more of the section of hair 36 into the device. Yet more (or all) of the section of hair 36 is drawn into the device during the second stage of movement, as represented by the relatively long substantially linear portion 44*d*. As explained in WO2014/122442, the sequential movement of the driving members 20, with the driving member 20 which is closest to the user's scalp moving first, minimises the tension applied to the section of hair 36 as it is drawn (progressively) into the device 10.

In addition, it can be arranged that the first driving member or rail, i.e. that closest to the user's scalp, moves relatively slowly during both its first and second stages of movement. This will minimise the tension placed upon the hair and reduce the force exerted at the user's scalp. Subsequent driving members can move more rapidly, it being recognised that tension in the section of hair farther from the user's scalp will be less likely to be exerted upon the user's scalp.

The section of hair 36 is set in its wave form, ideally by the application of heat. It will be understood that the section of hair can be set with the driving members 20 in their limit positions as represented in FIG. 5. That is not preferred, however, because the portions 44*d* are substantially linear in that limit position. Notwithstanding that the section of hair 36 may relax somewhat if the driving members 20 are held in their limit positions, any relaxation will be minor and cannot be controlled. This has the result that the device will produce relatively sharp waves with substantially linear sections separated by relatively sharp bends. A more aesthetically pleasing wave can be created by ensuring that the smaller sections of hair 36*a* relax into a more natural curve.

This is achieved with the present invention by moving the driving rails 20 away from their limit positions before the wave is set, i.e. towards the left as viewed in FIG. 5. The device can have a defined retracted position such as that described below in relation to FIG. 10, or the driving rails 20 can move back to their start position before the wave is set, as desired.

The second direction D2 can be considered to be the hair-deforming direction as most of the deformation of the section of hair 36 occurs in that direction. Movement of the driving rails 20 in the second direction D2 therefore corresponds to movement in the hair-deforming direction. It will be understood that as the driving member 20 moves in the hair-deforming direction the side 46*b* of the primary peg 22*a* engages the portion 44*c* and drives that portion in the hair-deforming direction to the limit position.

Subsequently, the forming member 20 is driven to reverse, i.e. to move in the direction opposed to D2. During this reverse movement, the side 46*c* of the neighbouring, secondary, peg 22*b* will engage the portion 44*c* of the smaller section of hair 36*a*. The section of hair 36 is not thereby forced out of the device 10, but rather the portion

44*c* is driven to move within the hair-receiving channel 38, and is for example caused to ride up the secondary peg 22*b* away from the linear edge 40. It can be arranged that the pegs 22*a,b* are long enough to accommodate the complete reversal of movement along the direction opposed to D2, or it can be arranged that the hair-receiving channel 38 is somewhat deeper than the length of the pegs 22*a,b* so that the portion 44*c* can pass over the top of the secondary peg 22*b* as the driving member 20 moves to the left as drawn. In any event, the reverse movement is sufficient so that the smaller section of hair 36*a* is no longer under any tension from the primary peg 22*a*, and is ideally positively pressed towards an unrestrained and more relaxed position by the secondary peg 22*b*. It is arranged that the portions of hair 44*a*, 44*c* and 44*d* retain some or all of their resilience and notwithstanding the confines of the hair-receiving channels 38 the largely unrestrained portions of hair adopt the smoothest curl available within the hair receiving channel 38. In practice, only the portions 44*a* passing underneath the linear sections 42 are relatively fixed in position along the smaller section of hair 36*a*, with the result that the remainder of the smaller section of hair 36*a* forms a series of relatively smooth loops within the hair-receiving channel 38. Since there are multiple smaller sections of hair 36*a* within each of the hair-receiving channels 38, all of which have undergone a similar wave-forming operation, in practice the loop of hair of one of the smaller sections 36*a* overlies the loops of other smaller sections within each of the hair-receiving channels.

The relaxation of the portions 44*c,d*, and the form of each of the resulting loops, is dependent upon the resilience of the section of hair 36, and is therefore enhanced if the section of hair 36 is relatively cool during this hair-deforming stage of the operation. It is thereby arranged that the hair is set into its wavy form, ideally by the application of heat as explained below, only after the driving members 20 have reversed to the retracted (or start) position.

Now that the principles of operation of the device 10 have been described, the specific embodiments will be explained in more detail.

Figure 6:
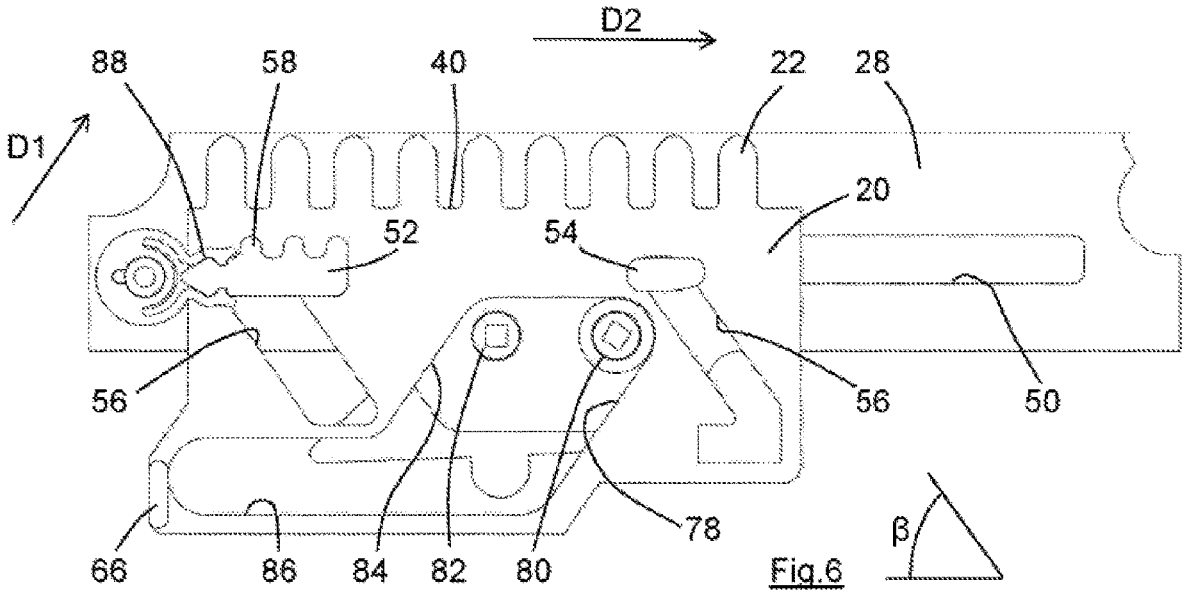
FIG. 6 shows a side view of a first embodiment of one of the drive mechanisms of the device of FIG. 1, in its start or rest position.

FIG. 6 shows one driving rail 20 in its start position and a neighbouring guard rail 28. A longitudinal channel 50 is formed in the guard rail 28, which channel locates a boss (not seen) attached to the rear side of a guide member 52 and a boss (not seen) attached to the rear side of the guide peg 54. The respective bosses and the channel 50 restrain the guide member 52 and guide peg 54 to longitudinal movement along the guard rail 28 (parallel with the second direction D2).

The forming rail 20 has two inclined guide channels 56, which contain the respective bosses of the guide member 52 and guide peg 54. The guide channels 56 are aligned at an acute angle β to the second direction D2.

Figure 7:
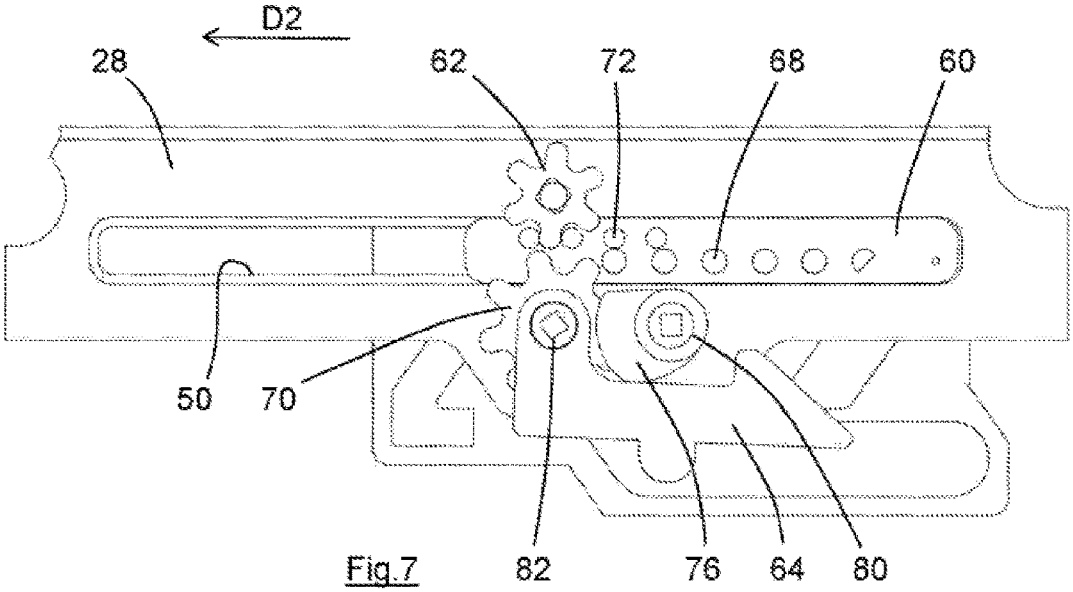
FIG. 7 shows the opposing side view of the drive mechanism of FIG. 6.

Connected to the other end of each of the bosses is a slide member or rack 60 as seen in FIG. 7. The guide member 52 and guide peg 54, and the rack 60, are therefore fixed to move together along the longitudinal channel 50, with the driving rail 20 and the guard rail 28 sandwiched therebetween.

FIGS. 6 and 7 show a single drive mechanism, i.e. a single driving rail 20 and a single guard rail 28, from opposing sides. It will be understood that in a preferred hair styling device there is a number of (identical) driving rails 20 and a number of (identical) guard rails 28, with each driving rail 20 being located between neighbouring guard rails 28. The drive mechanisms for each driving rail can be identical to that of FIGS. 6 and 7 as described below.

In the assembled hair styling device 10 each drive mechanism interacts with its neighbours to produce the interconnected and sequential movement of the driving rails 20 as explained in detail below. In particular, the secondary pinion 62 shown in FIG. 7 lies in the same plane as (and can engage) the tertiary pegs 58 of the guide member 52 of the neighbouring drive mechanism. Similarly, the latch 64 lies in the same plane as (and can engage) the block 66 of the driving rail 20 of the neighbouring drive mechanism.

It will be seen that the rack 60 carries a number of primary pegs 68 which are aligned with, and can engage, a primary pinion 70. The primary pinion 70 is the main drive pinion and is driven to rotate by a main drive motor (not shown) in the body 12.

The rack 60 also carries a number of secondary pegs 72 which are aligned with, and can engage, the secondary pinion 62. The secondary pinion 62 is passive in that it is not driven by a motor but is instead driven to rotate by the secondary pegs 72 of the present rack 60, or by the tertiary pegs 58 of the guide member 52 of the neighbouring drive mechanism, as described below.

The latch 64 is mounted to the guard rail 28 and is spring-biased to rotate anti-clockwise as viewed in FIG. 7. The latch 64 is engage by a cam 76. The primary pinion 70, a secondary pinion 62, a latch 64 and a cam 76 are mounted to the (fixed) guard rail 28, and a similar set of components is provided for each of the drive mechanisms.

A single main drive motor drives the primary pinion 70 of each of the drive mechanisms to rotate together. A single second drive motor (not shown) drives the cams 76 of each of the drive mechanisms to rotate together. Regardless of the number of drive mechanisms which are used in a particular hair styling device, only two motors are required to actuate all of the driving rails 20 to move sequentially as described in detail below.

Importantly, the cam 76 is not in the same plane as the primary pegs 68 (i.e. it is nearer the viewer than the primary pegs 68 in the orientation of FIG. 7). The body of the cam 76 can therefore rotate through 360° from the position shown without engaging or moving the primary pegs 68.

The cam 76 of the first driving rail 20 differs from the cams of the other driving rails in having an initiating element or finger (not seen) on its rear surface. The initiating finger extends into the same plane as the primary pegs 68 of the first drive mechanism and is positioned to engage the primary pegs 68 as the cam 76 rotates, as described below. The cam 76 is therefore a latch release cam for each of the drive mechanisms, and is also an initiating mechanism for the first drive mechanism.

The sequence of operations for a hair styling device comprising a plurality of drive mechanisms as shown in FIGS. 6 and 7 will now be described, starting from the position in which all of the driving rails 20 are in their start or rest position as represented in FIGS. 6 and 7. In that position, as seen in FIG. 7, the primary pegs 68 do not engage the primary pinion 70.

Firstly, the cam 76 is driven by a second drive motor to rotate through 360° in the anti-clockwise direction as viewed in FIG. 7. During this rotation, the initiating finger which is carried by the first cam 76 engages one of the primary pegs 68 of the first rack 60 and pushes the rack 60 in the direction D2. Because the cams 76 of the other drive mechanisms do not have an initiating finger their corresponding rotation causes no movement of the second, third etc. racks 60. The initiating finger pushes the (first) rack 60 sufficiently far to the left as viewed in FIG. 7 so that the leading primary peg 68 engages the teeth of the primary pinion 70.

The primary pinion 70 is then driven to rotate anti-clockwise as viewed in FIG. 7 whilst engaging the primary pegs 68. The first rack 60 is therefore driven further in the direction D2.

As the rack 60 moves in the direction D2 the bosses which are connected to the guide member 52 and guide peg 54 move relative to the respective angled guide channels 56 of the driving rail 20. It will be seen from FIG. 6 that the driving rail 20 has a centre slot 78, and that the drive shafts 80, 82 which interconnect all of the primary pinions 70 with the main drive motor, and which interconnect all of the cams 76 with the second drive motor, respectively, pass through the centre slot 78. When viewed in the orientation of FIG. 6, the shaft 82 limits the rightwards movement of the driving rail 20 and the angled edge 84 of the centre slot 78 causes the longitudinal movement of the rack 60 to be converted into an angled (upwards as viewed) movement of the driving member 20.

It will be understood that the direction of movement D1 of the driving rail 20 during this first stage of movement corresponds to the angle of the edge 84, which is around 60° in this embodiment.

The centre slot has an extension 86 which is aligned with the direction D2. It will be understood that, when the shafts 80, 82 enter the extension 86, the driving rail 20 moves solely in the direction D2.

The two-stage movement of the driving rail 20 is therefore caused by the shaping of the centre slot 78, with the driving rail 20 following a defined path as the shafts 80, 82 move along the respective edges of the centre slot 78 as the driving rail 20 is driven by the motion of the rack 60 along the longitudinal channel 50. In particular, because the edge 84 is linear, and because the extension 86 is linear, the path of movement of the driving member 20 in this embodiment is linear during both its first and second stages of movement.

The primary pinion 70 continues to rotate to drive rack 60 in the direction D2 by driving against the primary pegs 68. During this movement, the secondary pegs 72 are driven past the secondary pinion 62. Because there are fewer secondary pegs 72 than primary pegs 68, continued movement of the rack 60 causes the secondary pegs to disengage from the secondary pinion 62 before the rack 60 reaches the end of its movement in the direction D2.

As the rack 60 of the first driving mechanism approaches the end of its movement in the direction D2, the tertiary pegs 58 of the guide member 52 connected to that rack will engage the secondary pinion 62 of the neighbouring (second) drive mechanism. The second driving rail 20 is initially in its start position similar to that of FIG. 6, so that its secondary pegs 72 are already engaged with its secondary pinion 62. Consequently, as the primary pinion 70 continues to move the first rack 60 forwards, the rotation of the secondary pinion 62 of the second drive mechanism initiates the movement of the second driving rail 20. The first and second racks 60 are temporarily driven in the direction D2 simultaneously due to their both engaging the secondary pinion 62 of the second drive mechanism.

Just before the first driving rail 20 reaches its limit position, its primary pegs 68 become disengaged from its primary pinion 70. However, the second rack 60 is then moving forwards, driven by its primary pinion 70, and the secondary pegs 72 of the second rack continue to rotate its secondary pinion 62. Rotation of the secondary pinion 62 of the second drive mechanism drives the tertiary pegs 58 of the first rack 60, causing the first rack 60 to continue to move to its limit position despite the disengagement of its primary pegs 68 from its primary pinion 70.

The first driving rail 20 has at this point followed the path determined by the centre slot 78 to arrive at its limit position. During the final stage of forwards movement the block 66 of the first driving rail 20 passes the spring-biased latch 64 of the second drive mechanism. The latch 64 temporarily secures the first driving rail 20 in its limit position.

Figure 8:
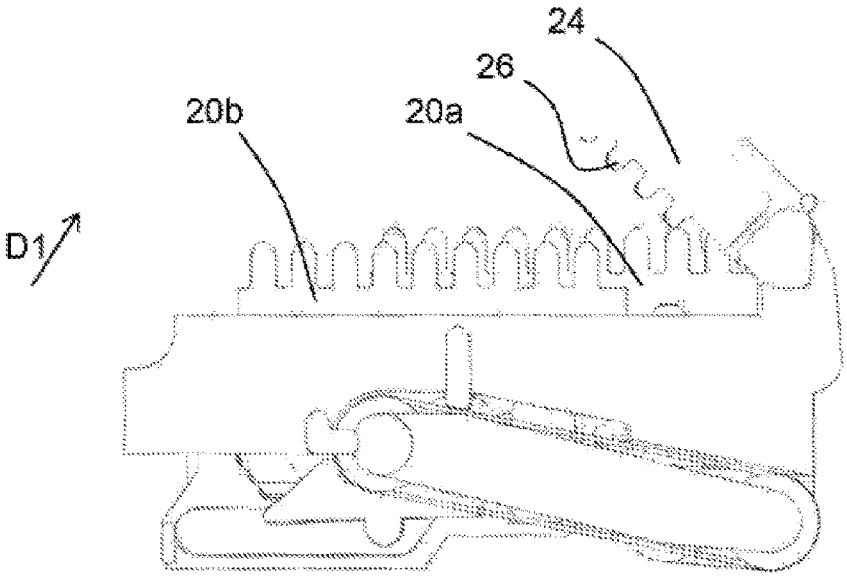
FIG. 8 shows a side view of the device of FIG. 1, with one of the driving rails in its limit position and another of the driving rails part-way through its movement in the first direction.

As the second rack 60 moves in the direction D2 its primary pegs 68 engage with its primary pinion 70 and rotation of the primary pinion 70 drives the second rack 60 to move, and consequently drives the second driving rail 20 to move, along a similar path to that of the first driving rail. The limit position of the first driving rail 20*a* is represented in FIG. 8. This figure also shows the second driving rail 20*b* undergoing its first stage of movement in the first direction D1.

Figure 9:
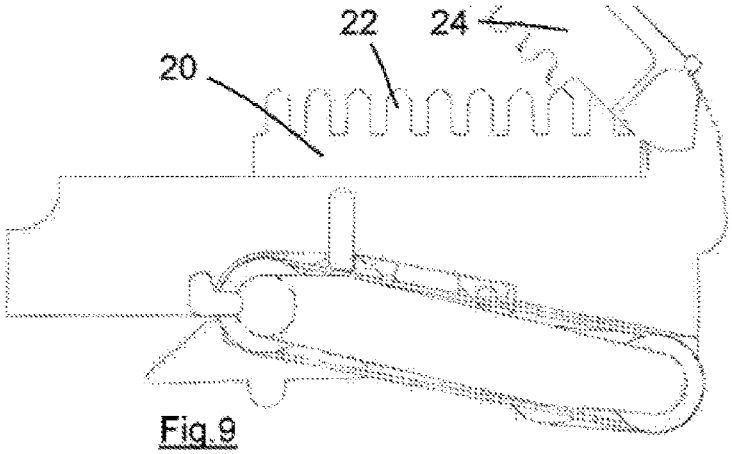
FIG. 9 shows a view as FIG. 8, with all of the driving rails at their limit positions.

The sequence continues to move all of the driving rails 20 sequentially, repeating the same interaction from one driving rail to the next until all the driving rails are latched in their limit positions. FIG. 9 shows a subsequent stage in the operation of the device, in which all of the driving rails 20 have reached their limit position. Only the nearest driving rail 20 is visible in FIG. 9 because the other driving rails are identically formed and are perfectly aligned behind it. It will be understood that the maximum deformation of the section of hair 36 occurs when all of the driving rails 20 are at their limit position.

Figure 10:
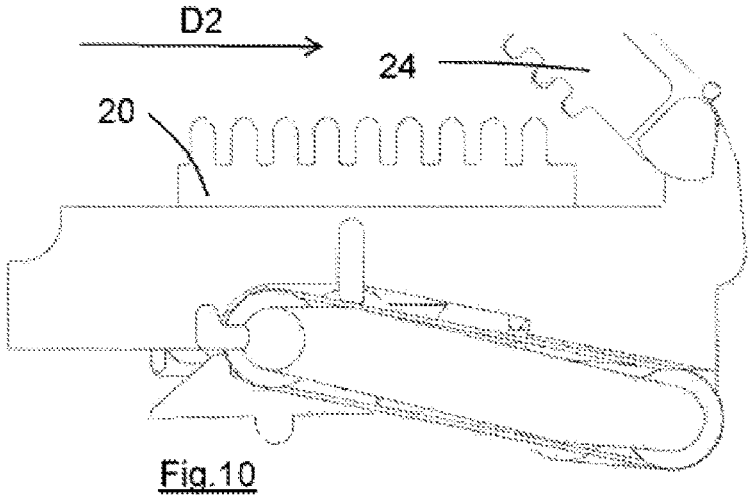
FIG. 10 shows a view as FIG. 9, with all of the driving rails moved back to their retracted positions.

If desired, the driving rails 20 can all remain latched in their limit positions during the hair styling operation, i.e. they can be retained there until the wave has been set. Preferably, however, when the final driving rail has been latched into its limit position the sequence of operations continues immediately to reverse all of the driving rails together and thereby to reduce the tension in the length of hair and permit the formation of a more natural wave. In this embodiment, all of the driving rails 20 move together back in a direction opposed to the second (or hair-deforming) direction D2, to the retracted position as shown in FIG. 10. As the tension is relieved the separate smaller sections of hair 36*a* relax into more natural-looking waves within the hair-receiving regions 38 as described above.

To reverse the movement of the driving rails, the second drive motor drives all of the cams 76 to rotate together in an anti-clockwise direction as viewed in FIG. 7, releasing all the latches 64 from their respective blocks 66 simultaneously. This unlocks all of the driving rails 20 to allow them to reverse (in the direction opposed to D2).

As each of the cams 76 rotates, it also engages the block 66 of the neighbouring driving rail 20. The cams 76 push against the respective block 66 and thereby push each of the driving rails 20 to reverse (together).

As the driving rails 20 reverse, their racks 60 move sufficiently in the direction opposed to D2 to engage the leading primary peg 68 with the respective primary pinion 70. When the leading primary peg 68 of each rack 60 is fully engaged with its respective primary pinion 70, the cams 76 return back to their rest position as shown in FIG. 7.

The main drive motor then rotates the primary pinions 70 to drive all the racks 60, and consequently all of the driving rails 20, to reverse. The driving rails 20 move a predetermined distance in the direction opposed to D2 to control the size of the wave, i.e. the reverse rotation of the primary pinions 70 is paused after a chosen number of rotations (or partial-rotations) to stop all of the driving rails 20 in a defined retracted position.

The driving members 20 can remain in the retracted position of FIG. 10 whilst the wave is set. In an alternative arrangement, the driving rails simply pass through the retracted position of FIG. 10 on their way back to their start positions, the length of hair being set only after the driving rails have been retracted back to their start positions. It will be understood that the section of hair 36 can more freely move in the hair receiving channels 38 when the driving members 20 have been moved back to their start positions (and the pegs 22 are no longer projecting into the hair-receiving channels 38). The degree of retraction can therefore be used to vary the wave which is formed in the length of hair, with more retraction giving more freedom to the section of hair 36 and generally providing a more natural looking wave.

When the driving rails 20 have been moved back to their desired retracted positions one or more heaters are actuated to heat the hair sufficiently to form the desired wave. When the hair has been heated sufficiently, the heaters are turned off and the heated components are allowed to cool to a lower idle temperature. Ideally the section of hair is retained in the device 10 as the components are cooled; this helps to form the desired wave by allowing the hair to cool whilst the wave form is maintained.

When the heating and cooling cycle is complete the primary pinions 70 act against the primary pegs 68 of each rack 60 simultaneously to drive all the racks, and consequently all of the driving rails 20, back to their start position. It will be understood that the racks 60 are driven to reverse until each rotating primary pinion 70 becomes disengaged from the trailing primary peg 68. In that position, the guide member 52 engages a resilient latch or clip 88 in order to temporarily secure the driving members 20 in their start position.

The drive system of the device 10 can therefore actuate multiple driving rails 20 to move along a predetermined path in a two-stage movement, with the driving members 20 moving sequentially to their limit positions. The drive system utilises only two motors so as to minimise the weight of the device 10 and has means to link the movement of one driving rail to its neighbouring driving rail. In an alternative arrangement, the movement of each driving rail 20 can be individually controlled, perhaps by one or more separate motors for each driving rail, if that is desired. Also, whilst the driving rails 20 move in the (angled) direction D1 during their first stage of movement, other drive systems may cause the driving rails to move in a direction perpendicular to the second direction D2 during the first stage of movement.

It will be understood that, when the shafts 80, 82 reach the bottom end (as viewed) of the edge 584 of the centre slot 78, the driving rail 20 has reached its intermediate position, i.e. it has reached the end of its first stage of movement and the end of its movement in the first direction D1. In that intermediate position the pegs 22, and also the linear edges 40 between the pegs 22, have moved into the hair-receiving channel 38 as represented in FIG. 4.

It will also be understood that, as the driving rail 20 moves in the direction D2 during its second stage of movement, the pegs 22 move along their respective hair-receiving channel 38 as represented in FIG. 5.

The sequential movement of the driving members 20 results in the gradual introduction of the length of hair into the device 10. In the representation of FIG. 2, the end 48 of the section of hair 36 represents the scalp end of the section of hair. The free end of the section of hair 36 extends beyond the right-hand edge of the page. It is arranged that the device 10 is oriented so that the driving rail 20 closest to the scalp end 48 moves first, with the neighbouring driving member moving second and so on. The scalp end of the section of hair 36 is relatively fixed and so movement of the first driving rail 20 causes more of the section of hair to be drawn in from the free end. Yet more of the section of hair 36 is drawn in as each subsequent driving rail 20 is moved as above explained, and ideally the free end of the section of hair 36 is drawn into the device before the last of the driving members 20 has reached its limit position (so that waves are imparted along the full length of the chosen section of hair). The number of driving rails, and the distance the driving rails move (particularly in the direction D2) can be chosen to ensure that a wave can be imparted to a section of hair up to a desired length.

FIGS. 8-10 show artificial positions in which the driving members 20 have moved whilst the closure part 16 is open, for the purposes of understanding. In practice, it is preferably arranged that the control system will not actuate the driving members 20 to move unless the closure part 16 is in its closed position.

As above stated, the device 10 includes electrical heating elements (not seen). A heating element can for example be located in each of the guard rails 28, and/or in each of the forming members 24. Alternatively, hot air can be blown along the hair-receiving channels to heat the section of hair and set the wave. Typically, a temperature of around 200° C. will be used to set the wave form in the section of hair, but it is recognised that different hair types will require different styling temperatures, and also a lower/higher temperature can be used together with a longer/shorter styling duration.

The closure part 16 can be opened (automatically) after a period of time, the period being determined by the user or preferably being predetermined as required to set the wave form. However, it is preferable to cool the section of hair 36 before it is removed from the device 10, so as to seek to minimise the subsequent loss of the wave form and also to reduce the pain caused in the event that a user inadvertently touches a heated part of the opened device.

In the first embodiment of hair styling device 10, an airflow generator (not seen, but ideally a fan or impeller) is mounted in the body 12 to pump ambient air into the device 10 to cool the (styled) section of hair 36 within the device. FIG. 1 shows grilles at the end of the body 12 and closure part 16 through which ambient air is admitted (or expelled, as desired), there being one or more corresponding grilles at the other end of the body. Desirably, the styled section of hair is cooled to a temperature of around 100° C. before the closure part 16 is opened and the styled section of hair is removed. It will be understood that moving the driving members 20 back to their start position before the airflow generator is actuated will facilitate airflow though the device, and in particular air flow along the hair-receiving channels 38.

It will be understood that the use of an airflow generator is optional and alternative embodiments can simply switch off the heat and rely upon radiation or convection to cool the heated parts of the device and the styled section of hair 36 before it is removed.

It is a benefit of a dual temperature regime that the next section of hair 36 can be inserted into a relatively cool device 10, the relatively cool surfaces being less likely to damage the section of hair as it is deformed, and also maintaining resilience in the section of hair as it is deformed. Accordingly, the section of hair only experiences the styling temperature (e.g. around 200° C.) when it has been deformed into a wavy form and subsequently allowed to relax in the hair-receiving channels 38.

It will be understood that the styling (high) temperature can be adjusted by the user in order to vary the wave which is formed. Similarly, the duration of the styling process for each section of hair can be adjusted to vary the wave which is formed.

In the embodiment shown the movement of the driving members is controlled by the longitudinal channel 50, by the guide channels 56, and by the opening or central slot 78, with the extent of movement in the first direction D1 in particular being determined by the length of the shorter guide channel 56 and the corresponding length of the edge 84 of the central slot 78. In alternative embodiments the movement of the driving members 20 in both directions D1 and D2 can be controlled, separately, thereby enabling the user to adjust the distance moved in each of those directions so as to vary the form of the wave. It is nevertheless desirable that each driving member of a hair styling device move by the same distance in both of the respective directions D1 and D2 so that a uniform wave is formed along the section of hair 36, even if each driving member is independently controlled and actuated.

The control system for the drive mechanisms, and in particular the control system for the main drive motor driving the primary pinions 70 and second drive motor driving the cams 76, is mounted in the body 12. The control system can measure the load upon the main drive motor and if the load exceeds a predetermined threshold it can stop the motor and open the closure part 16, it being recognised that a motor overload is likely to occur either if too much hair has been inserted into the device, or if the section of hair has become entangled. Once the closure part 16 has been opened it is expected that the user will be able to extract the section of hair and re-start the process.

The control system can also communicate with sensors positioned to detect misplaced hair. For example, the guides 30 and/or 32 can carry sensors (perhaps optical sensors) adapted to detect the presence of hair which might become inadvertently trapped between one of those guides and the closure part 16. The control system can prevent movement of the driving members 20 and issue a warning signal to the user if misplaced hair is detected.

Whilst the drawings show a specific embodiment having elongate driving rails 20 and similarly elongate forming rails 24, it will be understood that the rails could be replaced by much shorter driving and forming members, each perhaps having just two pegs 22,26. Such a device would be suitable for styling a bundle of hair rather than a ribbon of hair but could nevertheless benefit from some of the advantages of the invention.

A second embodiment of drive mechanism is shown in FIGS. 11-15. This embodiment differs structurally from the first embodiment of drive mechanism of FIGS. 6-10, and also in terms of its method of operation, as described below. Whilst the differences are described below, it will be understood that there are many similarities (including for example the general principle of operation described in relation to FIGS. 3-5); a number of drive mechanisms according to the second embodiment could for example be used in a hair styling device similar to that of FIG. 1.

Firstly, the pegs 122 of the driving rails 120 are significantly shorter (in the direction perpendicular to the second direction D2) than the pegs 22 (in this embodiment the pegs 122 have a height of 6 mm as compared to a height of 15 mm for the pegs 22). Also, the distance which the driving rails 120 move perpendicular to the second direction D2 is reduced. Both of these structural modifications reduce the dimension of the drive mechanism perpendicular to the second direction D2, and thereby enable a reduction in the overall size of the hair styling device.

Secondly, the pegs 122 are angled in the second direction D2, and are more sharply pointed. These structural modifications help to ensure that the pegs 122 effectively capture all of the individual hairs in the section of hair being styled, and (further) reduce the likelihood of any individual hairs becoming trapped by parts of the hair styling device in use.

Thirdly, the side 146*c* of each of the pegs 122 is angled so as to cause the length of hair to be more positively pushed away from the linear edge 140 of the driving rail 120 when the movement of the driving rail is reversed. This structural modification encourages the length of hair to relax into a more natural wave as the driving rails are reversed.

Fourthly, the second embodiment of drive mechanism does not include a secondary pinion, nor therefore secondary pegs or tertiary pegs. The interactions between neighbouring drive mechanisms are provided by other parts of the mechanism as described below.

Fifthly, the shape and location of the latch 164 has been altered, which also reduces the dimension of the drive mechanism in the direction perpendicular to the second direction D2 and enables a reduction in the size of the hair styling device.

One major similarity between the first and second embodiments of drive mechanism is that parts of each drive mechanism are located to opposing sides of a guard rail. In particular, the driving rail 20, 120 with its pegs 22, 122 is located to one side of the guard rail 28, 128 and is connected to a rack 60, 160 at the other side of the guard rail. The connection is made by way of bosses which pass through an elongate longitudinal channel 50, 150 in the guard rail. The bosses slide along the channel 50, 150 to provide support and guidance to the driving rails 20, 120 during their movement. Also, there are multiple drive mechanisms and some of the componentry of the first drive mechanism interacts with componentry of the second drive mechanism (and so on) so that the movements of the respective driving rails can be linked. This latter commonality minimises the number of motors required in a practical device, as above explained.

Figure 11:
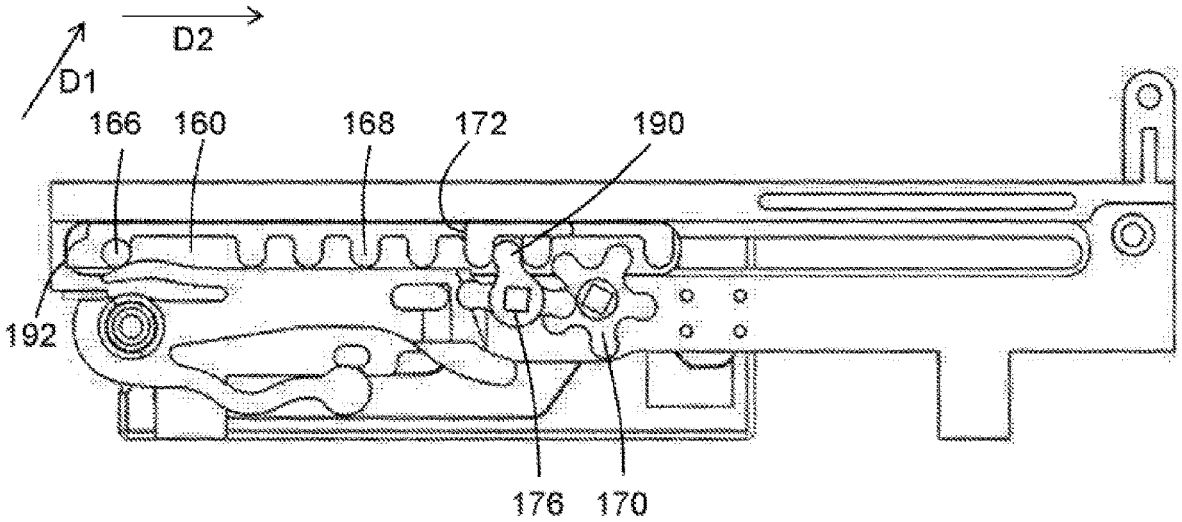
FIG. 11 shows a view similar to that of FIG. 6 of a second embodiment of drive mechanism.
Figure 14:
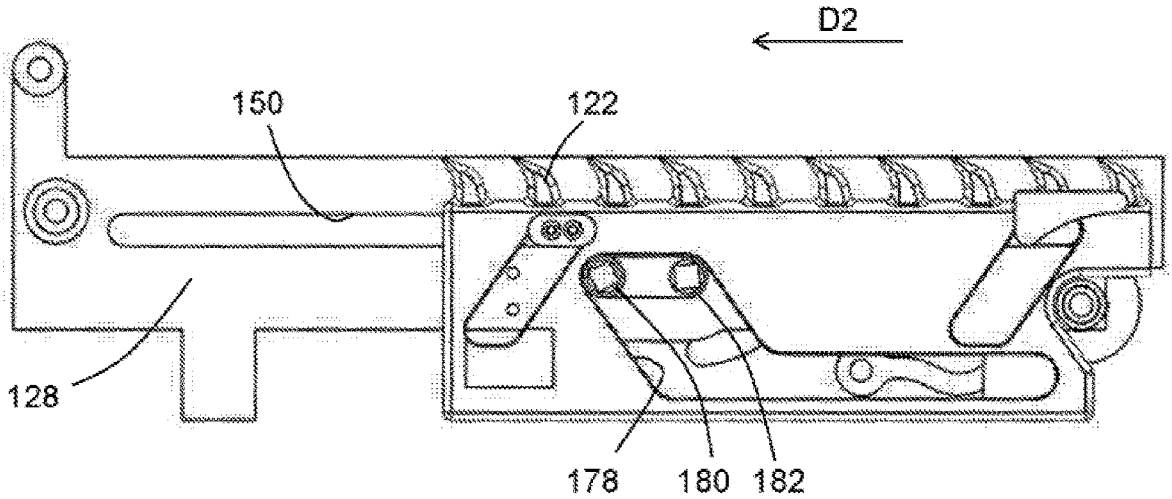
FIG. 14 shows a view of the second embodiment of drive mechanism of FIG. 11 from the opposing side.

Other structural differences, and the resulting changes to the operation of the drive mechanisms, are described in the sequence of operations below, again starting from the position in which all of the driving rails 120 are in their start position as represented in FIGS. 11 and 14. In that position, as seen in FIG. 11, the primary pegs 168 do not engage the primary pinion 170.

Initially, the cam 176 is rotated in the clockwise direction as viewed in FIG. 11. During this rotation, the extra lobe 190 which is carried by the cam 176 of the first drive mechanism acts as an initiating element and engages one of the primary pegs 168 of the first rack 160 and pushes the rack 160 in the direction D2). The cams 176 of the other drive mechanisms do not have an extra lobe and so their corresponding rotation causes no movement of the second, third etc. racks 160. The extra lobe 190 pushes the (first) rack 160 sufficiently far in the direction D2 so that the leading primary peg 168 engages the teeth of the primary pinion 170.

The primary pinion 170 is then driven by a main drive motor (not shown) to rotate clockwise as viewed in FIG. 11 whilst engaging the primary pegs 168. The rack 160 is therefore driven in the direction D2.

As with the first drive mechanism described above, the two-stage movement of the driving rail 120 is caused by the shaping of the centre slot 178 (see FIGS. 14 and 15), i.e. the drive shafts 180, 182 of the respective main drive motor and second drive motor (not shown) are fixed in position and cause the driving rail 120 to move in the directions D1 and D2 following the shape of the centre slot 178, and driven by the motion of the rack 160 along the longitudinal channel 150.

The primary pinion 170 continues to rotate to drive rack 160 in the direction D2 by driving against the primary pegs 168. As the rack 160 moves forwards, the guide member 152 of the first rack 160 will engage the edge 172 of a raised section of the neighbouring (second) drive mechanism. It will be understood that the raised section stands proud of the remainder of the rack 160, and so is nearer to the viewer than the remainder of the rack 160 as viewed in FIG. 11. The second driving rail 120 is initially in its start position similar to that of FIG. 11. Consequently, as the guide member 152 of the first drive mechanism moves in the direction D2 it initiates the movement of the second drive mechanism by pushing the edge 172 and consequently the second rack 160 in the direction D2. The first and second racks 160 are temporarily driven forward simultaneously due to the interengagement of the guide member 152 and edge 172.

The trailing end 192 of the rack 160 lies in the same plane as the latch 164. As the first driving rail 120 moves towards its limit position, the trailing end 192 passes the end of the inclined edge 194 of the latch 164 (see FIG. 13). The latch is spring biased anti-clockwise as viewed in FIGS. 11 and 12, and as the trailing end 192 of the rack 160 moves past the inclined edge 194 the latch rotates a few degrees anti-clockwise to move behind the trailing end 192, as shown in FIG. 12.

Figure 12:
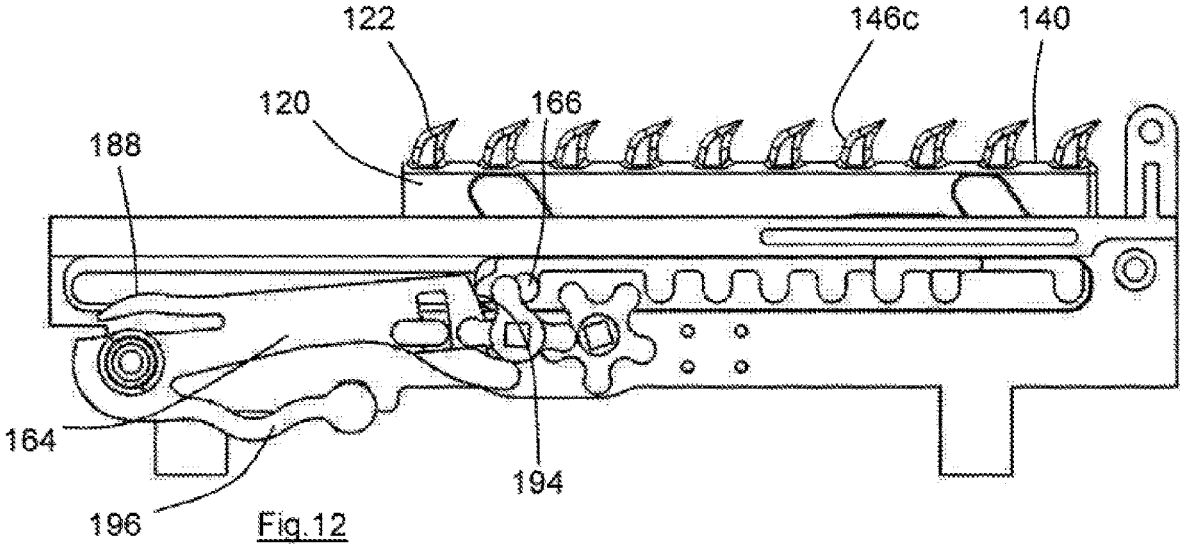
FIG. 12 shows the drive mechanism of FIG. 11 with the driving rail in its limit position.
Figure 13:
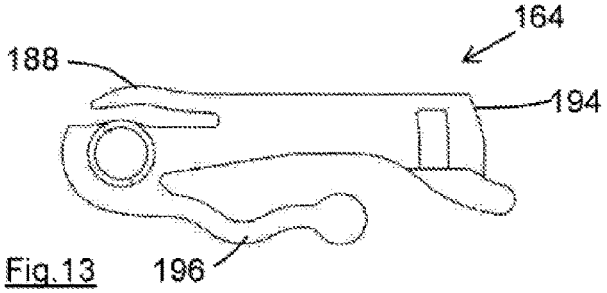
FIG. 13 shows the latch of the second embodiment of drive mechanism.
Figure 15:
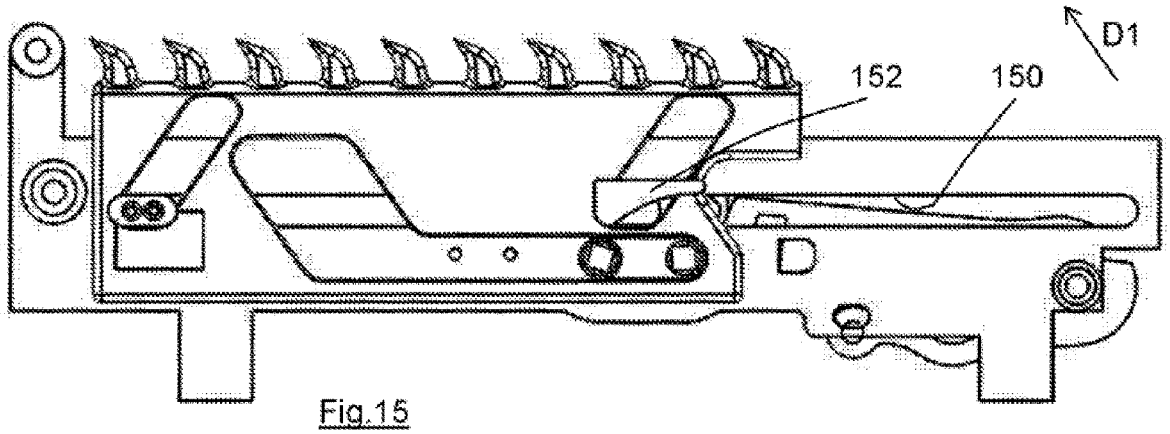
FIG. 15 shows a view of the second embodiment of drive mechanism of FIG. 12 from the opposing side.

The spring-biasing of the latch 164, and the angling of the inclined edge 194 act to move the rack 160 further in the direction D2 to its limit position, notwithstanding that the primary pegs 168 have become disengaged from the primary pinion 170 as also seen in FIG. 12. The latch 164 therefore temporarily secures the first driving rail 120 in its limit position as shown in FIGS. 12 and 15.

As the second rack 160 moves in the direction D2 its primary pegs 168 engage with its primary pinion 170 and rotation of the primary pinion 170 drives the second rack 160 to move, and consequently drives the second driving rail 120 to move, along a similar path to that of the first driving rail. The sequence continues to move all of the driving rails 120 sequentially, repeating the same interaction from one driving rail to the next until all the driving rails are latched in their limit positions.

To reverse the movement of the driving rails, the second drive motor rotates the cams 176 in an anti-clockwise direction as viewed in FIG. 12, releasing all the latches 164 simultaneously. This unlocks all of the driving rails 120 to allow them to reverse. Also, as each of the cams 176 rotates, it engages a peg 166 of the rack 160. The cams 176 push against the respective pegs 166 and thereby push each of the driving rails 120 to reverse (together). As the driving rails 120 reverse, their racks 160 move sufficiently to engage the primary pegs 168 with the respective primary pinions 170. The primary pinions 170 then rotate (anticlockwise as viewed in FIG. 11) to drive all the racks 160, and consequently all of the driving rails 120, in the direction opposed to D2.

As with the first embodiment, all of the driving members 120 may be moved to a retracted position at which heat is applied to set the wave in the section of hair; alternatively, the driving rails 120 can be moved directly back to the start or rest position.

At the end of the cycle, each of the racks 160 is driven to reverse until each rotating primary pinion 170 becomes disengaged from the primary pegs 168 as seen in FIG. 11. In that position, the peg 166 of the rack 160 has passed the spring-biased projection 188 of the latch 164, the resilience of the projection 188 temporarily securing the driving rail 120 in its start position.

Whilst both of the drive mechanisms described above incorporate two motors, it will be understood that (apart from the initiating movement of the first driving rails 20, 120) all of the driving rails 20, 120 are driven from their start positions to their limit positions by a single main drive motor. Other embodiments can exclude the second motor of the above-described embodiments so that the drive systems include only a single motor. For example, the initiating element could comprise an extra tooth of the rack of the first driving rail so that the rack of the first drive mechanism remains engaged with its pinion in the start position (thereby avoiding the requirement of the second motor to initiate the movement of the first driving rail).

Also, the latches which temporarily secure the driving rails in their limit positions could be excluded, with the respective (rotating) pinions maintaining the driving rails in their limit positions (thereby avoiding the requirement for the second motor to actuate the latch releasing mechanisms). Even in embodiments in which the driving rails are latched in their limit positions, however, other means (such as one or more solenoids for example) may be provided to release the latch mechanisms and to move the driving rails away from their limit positions so as to engage the main drive motor.

In another alternative drive system incorporating only a single motor, the last drive mechanism could exclude a latch mechanism, and instead could incorporate a latch release mechanism for the latches of the other drive mechanisms. In such an arrangement, the first, second etc. up to the penultimate driving rail could be latched into its respective limit position, and the latch mechanisms could be released (and all of the driving rails driven away from their limit positions), by movement of the final driving rail as it approaches its limit position.

In yet another alternative drive system incorporating only a single motor, the single motor may be connected to separate drive systems, one of the drive systems rotating the pinions 70, 170 and the other drive system rotating the cams 76, 176. Suitable control systems can be incorporated to connect/disconnect the motor from the separate drive systems during different stages of operation.

Figure 16:
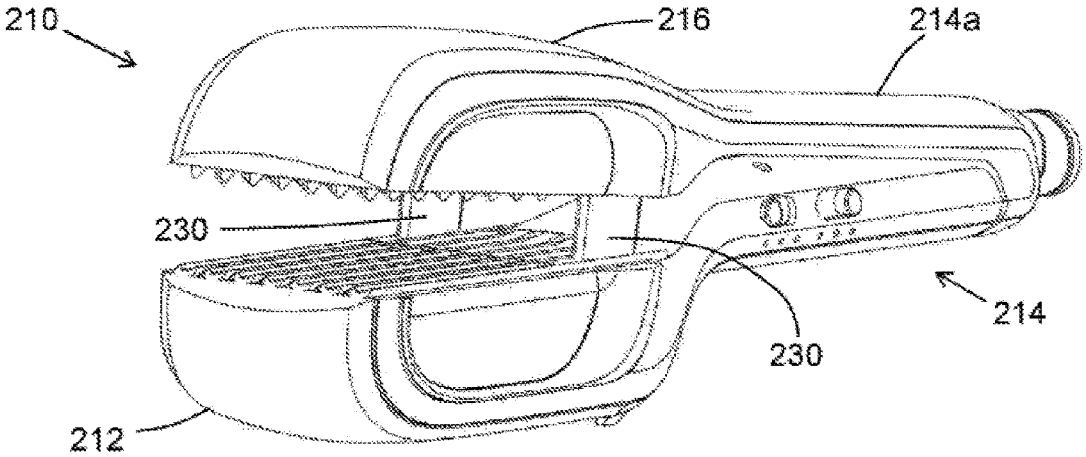
FIG. 16 shows a perspective view of a second embodiment of hair styling device according to the present invention, in its open condition.

FIG. 16 shows a second embodiment of hair styling device 210 comprising a body 212 with an integral handle 214. Connected to the body 212 is a closure part or lid 216. This embodiment has a two-part handle 214, the closure part 216 being connected to a second handle part 214*a* permitting the user to move the closure part 216 to its closed position by pressing the handle parts together, in known fashion. The handle parts are preferably biased apart to their open position as shown in FIG. 15. The handle 214 of this second embodiment is substantially aligned with the longitudinal axis of the driving rails 220 so that the handle has a "wand-like" orientation, as opposed to the "pistol grip" orientation of the first embodiment.

Another significant difference over the first embodiment described above is that the guides 230 completely span the distance between the body 212 and the closure part 216 in the open condition shown, and thereby prevent any hair being inserted into the device in a position where it may become trapped. The guide parts 230 are mounted to project (downwardly as viewed) from the closure part 216 and as the device is closed the guide parts move (further) into cooperating recesses in the body 112. In an alternative embodiment the guide parts are mounted to project (upwardly) from the body and as the device is closed the guide parts move (further) into cooperating recesses in the closure part.

The hair styling device 210 could have a drive system incorporating the first embodiment of drive mechanism of FIGS. 6-10, or the second embodiment of drive mechanism of FIGS. 11-15, as desired.

Figure 17:
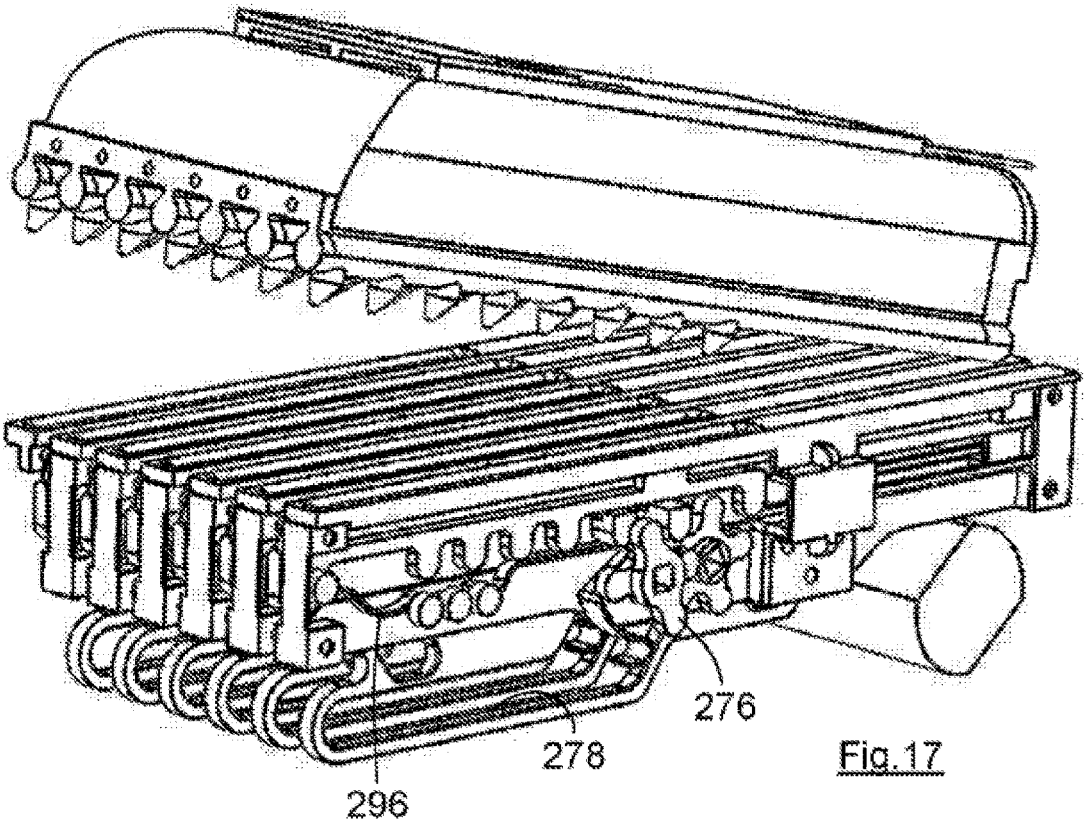
FIG. 17 shows the drive mechanisms of the second embodiment of hair styling device, with all of the driving rails in their start positions.
Figure 18:
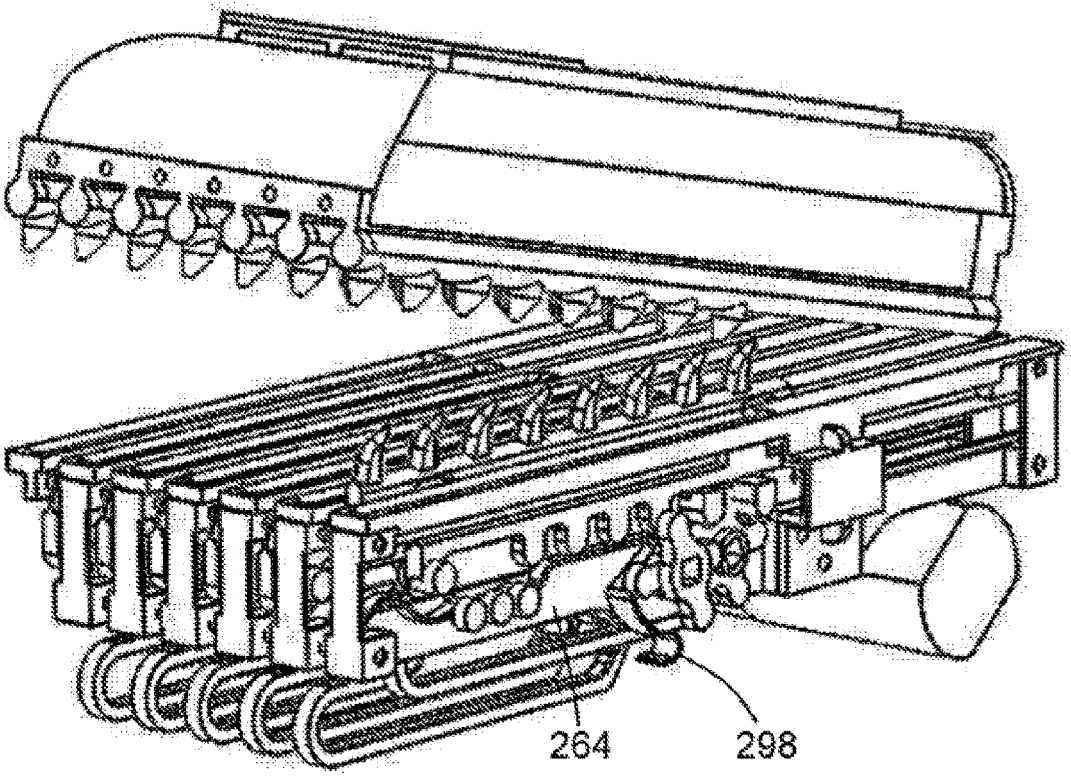
FIG. 18 shows a view as FIG. 17 but with the first driving rail part-way through its range of movement.

The drive system is shown in FIGS. 17 and 18 separate from the surrounding housing parts. The drive system is a slightly modified version of the second embodiment of drive mechanism, which is preferred because of its reduced dimension perpendicular to the second direction D2.

The drive mechanisms of the hair styling device 210 are very similar to the second embodiment of drive mechanism described above and their operation is the same and will not be repeated. However, it is apparent from FIGS. 17 and 18 that much of the material surrounding the central slot 278 has been removed to save material and weight. Also, the latch 264 incorporates a metallic resilient element 296 in place of the moulded plastic resilient element 196 of the second embodiment of drive mechanism (it will be understood that a metal spring is more likely to maintain its resilience over time at the temperatures expected to be encountered by the latch). Furthermore, the latch 264 has a metallic element 298 which is engaged by the cam 276.

The invention claimed is:

1. A hair styling device for imparting a wave to a section of hair without clamping the section of hair to which the wave is imparted, the device having a first forming member and a second forming member comprising a first pair of neighboring forming members, a first hair-receiving region between the first forming member and the second forming member, the device having a second pair of neighboring forming members with a second hair-receiving region between the second pair of neighboring forming members, the device having multiple driving members including at least a first driving member and a second driving member, the first driving member being movable relative to the first forming member and the second forming member to engage the section of hair and to deform the section of hair in the first hair-receiving region in use, the second driving member being movable relative to the second pair of neighboring forming members to engage the section of the hair and to deform the section of hair in the second hair-receiving region in use, the first and second driving members undertaking a two-stage movement as they deform the section of hair, the driving members in a first stage being movable in a first direction to drive the section of hair into the respective hair-receiving region in use, the driving members in a second stage being movable in a second direction, the second direction being at an angle to the first direction whereby in use to further move the section of hair in the respective hair-receiving region, in which at least one of the forming members has a plurality of upstanding forming elements which in use separate the section of hair into smaller sections of hair between respective forming elements.

2. The hair styling device according to claim 1 in which the driving members move linearly during the first stage.

3. The hair styling device according to claim 1 in which the driving members move linearly during the second stage.

4. The hair styling device according to claim 1 in which the driving members are movable in the first stage from a start position to an intermediate position, and are movable in the second stage from the intermediate position to a limit position.

5. The hair styling device according to claim 4 in which a part of each driving member is outside the respective hair-receiving region in the start position and inside the hair-receiving region in the intermediate position.

6. The hair styling device according to claim 1 in which each driving member has an opening, the opening having an edge which determines the distance and angle of the first direction in the first stage, and an extension which determines the distance and angle of the second direction in the second stage.

7. The hair styling device according to claim 1 in which the movement of each of the driving members is controlled by a respective drive mechanism, the driving members of at least two of the drive mechanisms being actuated by a single motor.

8. The hair styling device according to claim 7 in which the at least two of the drive mechanisms are mechanically identical.

9. The hair styling device according to claim 1 in which each hair-receiving region is a channel and the forming members are elongated in the direction of the longitudinal axis of the channel.

10. The hair styling device according to claim 1 in which the driving members have a plurality of upstanding driving elements which in use separate the section of hair into smaller sections of hair between respective driving elements.

11. The hair styling device according to claim 1 having a body and a closure part, the closure part being movable relative to the body between an open position and a closed position, the driving members being mounted to the body and the forming members being mounted to the closure part.

12. The hair styling device according to claim 11 in which the driving members have a plurality of upstanding driving elements which in use separate the section of hair into smaller sections of hair between respective driving elements, and in which the driving elements overlap the forming elements when the closure part is in its closed position.

13. A hair styling device for imparting a wave to a section of hair without clamping the section of hair to which the wave is imparted, the device having a first forming member and a second forming member comprising a first pair of neighboring forming members, a first hair-receiving region between the first forming member and the second forming member, the device having a second pair of neighboring forming members with a second hair-receiving region between the second pair of neighboring forming members, the device having multiple driving members including at least a first driving member and a second driving member, the first driving member being movable relative to the first forming member and the second forming member to engage the section of hair and to deform the section of hair in the first hair-receiving region in use, the second driving member being movable relative to the second pair of neighboring forming members to engage the section of hair and to deform the section of hair in the second hair-receiving region in use, the first and second driving members undertaking a two-stage movement as they deform the section of hair, the driving members in a first stage being movable in a first direction to drive the section of hair into the respective hair-receiving region in use, the driving members in a second stage being movable in a second direction, the second direction being at an angle to the first direction whereby in use to further move the section of hair in the respective hair-receiving region, in which the driving members have a primary driving element which is adapted to drive the section of hair in a hair-deforming direction, the driving members also having a secondary driving element which is adapted to drive the section of hair in a direction opposed to the hair-deforming direction.

14. A method of imparting wave to a section of hair without clamping the section of hair, with a hair styling device having a first forming member and a second forming member comprising a first pair of neighboring forming members, a first hair-receiving region between the first forming member and the second forming member, the device having a second pair of neighboring forming members with a second hair-receiving region between the second pair of neighboring forming members, the device having multiple driving members including at least a first driving member and a second driving member, the first driving member being movable relative to the first forming member and the second forming member, the second driving member being movable relative to the second pair of neighboring forming members, the first and second driving members undertaking a two-stage movement comprising the steps of:

{i} moving the first driving member in a first direction in a first stage of movement, the first driving member engaging a first portion of the section of hair and deforming the first portion of the section of hair into the first hair-receiving region;

{ii} moving the first driving member in a second direction in a second stage of movement, the second direction being at an angle to the first direction, the first driving member further deforming the first portion of the section of hair in the first hair-receiving region;

{iii} moving the first driving member in a direction opposed to the second direction and allowing the first portion of the section of hair to relax in the first hair-receiving region;

{iv} moving the second driving member in the first direction in a first stage of movement, the second driving member engaging a second portion of the section of hair and deforming the second portion of the section of hair into the second hair-receiving region;

{v} moving the second driving member in a second direction in a second stage of movement and further deforming the second portion of the section of hair in the second hair-receiving region;

{vi} moving the second driving member in a direction opposed to the second direction and allowing the second portion of the section of hair to relax in the second hair-receiving region; and, {vii} setting the style in the section of hair.

15. The method according to claim 14 in which the hair styling device has at least one heating element and a controller to actuate the heating element, and in which the controller is configured to actuate the heating element after step {iii}.

16. The method according to claim 15 in which there is a predetermined delay between switching off the heating element and releasing the styled section of hair from the device.

17. The method according to claim 15 in which at least part of the sequence of steps {iv}, {v} and {vi} is undertaken at the same time as at least part of the sequence of steps {i}, {ii} and {iii}.

* * * * *